US008730001B2

(12) United States Patent
Yoshikawa et al.

(10) Patent No.: US 8,730,001 B2
(45) Date of Patent: May 20, 2014

(54) REACTOR AND REACTOR-USE COMPONENT

(75) Inventors: Kouhei Yoshikawa, Osaka (JP); Masayuki Katou, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 13/387,960

(22) PCT Filed: Jul. 26, 2010

(86) PCT No.: PCT/JP2010/062507

§ 371 (c)(1),
(2), (4) Date: Jan. 30, 2012

(87) PCT Pub. No.: WO2011/013607

PCT Pub. Date: Feb. 3, 2011

(65) Prior Publication Data

US 2012/0126928 A1 May 24, 2012

(30) Foreign Application Priority Data

| | | |
|---|---|---|
| Jul. 31, 2009 | (JP) | 2009-179998 |
| Aug. 25, 2009 | (JP) | 2009-193833 |
| Aug. 31, 2009 | (JP) | 2009-199648 |
| Jul. 13, 2010 | (JP) | 2010-159158 |

(51) Int. Cl.

| | |
|---|---|
| ***H01F 17/04*** | (2006.01) |
| ***H01F 17/06*** | (2006.01) |
| ***H01F 27/30*** | (2006.01) |
| ***H01F 27/24*** | (2006.01) |

(52) U.S. Cl.
USPC ..... 336/221; 336/178; 336/205; 336/208; 336/212; 336/233

(58) Field of Classification Search
USPC ..... 336/90, 178, 184, 196, 205, 206, 209, 336/212, 221, 233, 234, 208
See application file for complete search history.

(56) References Cited

U.S. PATENT DOCUMENTS 2,992,405 A * 7/1961 Ursch ..... 336/55
3,244,960 A * 4/1966 Stevens et al. ..... 363/126

(Continued)

FOREIGN PATENT DOCUMENTS

CN 101405822 A 4/2009
JP S50-121958 U 10/1975

(Continued)

OTHER PUBLICATIONS

Kouhei Yoshikawa et al., U.S. Appl. No. 13/259,658, "Reactor," filed Sep. 23, 2011.

(Continued)

*Primary Examiner* — Alexander Talpalatski
*Assistant Examiner* — Mangtin Lian
(74) *Attorney, Agent, or Firm* — Venable LLP; Michael A. Sartori; Tamatane J. Aga

(57) ABSTRACT

Provided is a reactor and a reactor component that can prevent cracking of a resin portion that is interposed between a coil and an internal core portion. The reactor includes a coil 10 and a core that includes an internal core portion 22 and a couple core portion 24. The coil 10 is formed by helically winding a wire. The internal core portion 22 is disposed inside the coil and forms a part of a closed magnetic path. The couple core portion 24 is joined to the internal core portion 22 and forms the remaining part of the closed magnetic path. The reactor includes a resin portion (internal resin portion 30) including a region that is interposed between the coil 10 and the internal core portion 22, and a cushioning member 70 that is interposed between the resin portion and the internal core portion 22 and that does not cover the couple core portion 24. It is preferable that the material of the cushioning member 70 has a Young's modulus that is smaller than a resin material of the resin portion.

11 Claims, 14 Drawing Sheets

(56) References Cited

U.S. PATENT DOCUMENTS

| | | | | | |
|---|---|---|---|---|---|
| 3,587,168 | A | * | 6/1971 | Kolator | 29/605 |
| 3,711,807 | A | * | 1/1973 | Yamashita et al. | 336/205 |
| 3,774,298 | A | * | 11/1973 | Eley | 29/605 |
| 4,137,515 | A | * | 1/1979 | Akao et al. | 336/84 C |
| 4,239,077 | A | * | 12/1980 | Dixon et al. | 156/273.5 |
| 4,586,016 | A | * | 4/1986 | Rilly et al. | 336/96 |
| 5,926,946 | A | * | 7/1999 | Minato et al. | 29/606 |
| 6,750,749 | B2 | * | 6/2004 | Shirahata et al. | 336/55 |
| 6,950,004 | B2 | * | 9/2005 | Godoy et al. | 336/160 |
| 2002/0057180 | A1 | | 5/2002 | Shirahata et al. | |
| 2003/0020588 | A1 | * | 1/2003 | Jin et al. | 336/233 |
| 2004/0257190 | A1 | * | 12/2004 | Peck et al. | 336/212 |
| 2009/0108971 | A1 | * | 4/2009 | Okamoto | 336/65 |
| 2011/0025444 | A1 | * | 2/2011 | Sugiyama et al. | 336/212 |
| 2012/0092120 | A1 | | 4/2012 | Yoshikawa et al. | |
| 2012/0126928 | A1 | | 5/2012 | Yoshikawa et al. | |
| 2012/0206232 | A1 | | 8/2012 | Yamamoto et al. | |

FOREIGN PATENT DOCUMENTS

| | | | | |
|---|---|---|---|---|
| JP | S55-030812 | A | | 3/1980 |
| JP | 57-056911 | A | | 4/1982 |
| JP | 11-288824 | A | | 10/1999 |
| JP | 2003-197444 | A | | 7/2003 |
| JP | 2004-095570 | A | | 3/2004 |
| JP | 2004-327569 | A | | 11/2004 |
| JP | 2005-019764 | A | | 1/2005 |
| JP | 2005-135976 | A | | 5/2005 |
| JP | 2006-004957 | A | | 1/2006 |
| JP | 2007-027185 | A | | 2/2007 |
| JP | 2007-134374 | A | | 5/2007 |
| JP | 2007-180224 | A | | 7/2007 |
| JP | 2008-028290 | A | | 2/2008 |
| JP | 2008-041877 | A | | 2/2008 |
| JP | 2008-042051 | A | | 2/2008 |
| JP | 2008041879 | A | | 2/2008 |
| JP | 2008-153299 | A | | 7/2008 |
| JP | 2008-311284 | A | | 12/2008 |
| JP | 2009-026995 | A | | 2/2009 |
| JP | PCT/IB09/05071 | | * | 2/2009 |
| JP | 2009-246219 | A | | 10/2009 |
| WO | WO-2010/021113 | A1 | | 2/2010 |
| WO | WO-2010/110007 | A1 | | 9/2010 |

OTHER PUBLICATIONS

Notice of Allowance and Allowability in U.S. Appl. No. 13/393,501 dated Dec. 11, 2012.

Office Action in Chinese Patent Application No. 201080034098.2 dated Mar. 14, 2013.

Notification of Reasons for Rejection in Japanese Patent Application No. 2010-097356, dated Sep. 5, 2013.

* cited by examiner (A)

(B)

(A)

(B)

REACTOR AND REACTOR-USE COMPONENT

TECHNICAL FIELD

The present invention relates to a reactor and a reactor component. In particular, the present invention relates to a reactor in which a coil is molded with a resin portion and cracking of the resin portion that is interposed between a core and the coil is less likely to occur when the reactor is subjected to a thermal cycle.

BACKGROUND ART

Reactors that are mounted in vehicles such as electric vehicles and hybrid vehicles include a core and a coil wound around the core. Usually, the coil includes a pair of coil elements that are coupled parallel to each other. The core, which has an annular shape, is fitted into the coil elements.

To be specific, PTL 1 discloses a reactor including a core having a portion around which a coil is wound (internal core portion) and a portion (couple core portion) around which a coil is not wound. The couple core portion protrudes further in up-down and left-right directions than the internal core portion. With such a configuration, an assembly including the core and the coil has a substantially rectangular block-like shape, and therefore the size of the reactor is reduced.

PTL 2 discloses a reactor in which an assembly including a core and a coil is covered by a resin in order to mechanically protect the assembly.

CITATION LIST

Patent Literature

PTL 1: Japanese Unexamined Patent Application Publication No. 2004-327569 (FIG. 1)

PTL 2: Japanese Unexamined Patent Application Publication No. 2007-180224 (FIG. 7)

SUMMARY OF INVENTION

Technical Problem

Usually, a coil itself tends to extend and contract before the coil is mounted in a reactor. Therefore, the shape of the coil is unstable and it is difficult to handle the coil. In particular, there may be large gaps between adjacent turns of a coil due to springback of the coil. Such a coil has a large axial length if the coil is used as it is, and thus the size of the reactor is increased.

To address these problems, a configuration in which a coil is covered by a resin has been examined. With this configuration, the productivity of the reactor can be improved because the coil does not extend and contract and it is easy to handle the coil during assembly of the reactor.

However, it has been found that a reactor having a coil that is molded with a resin portion has a problem in that cracking of the resin portion occurs at a specific position due to a thermal cycle. It is required that vehicle parts such as a reactor be usable, for example, in a range of about −40 to 150° C. with consideration of the use environment and the operating temperature. A thermal cycle test in such a temperature range was carried out on a reactor having a coil molded with a resin portion, and it was found that cracking often occurs at the resin portion that is interposed between the coil and the internal core portion.

The present invention has been achieved in view of the circumstances described above, and an object of the present invention is to provide a reactor that can prevent cracking of a resin portion that is interposed between a coil and an internal core portion.

Solution to Problem

The inventors examined a method for handling a coil as a component that does not extend and contract by molding the coil with a resin portion and retaining the shape of the coil using the resin portion. At this time, whether or not cracking of the resin portion occurs was examined by performing a thermal cycle test between the lowest possible temperature (for example, about −40° C.) in the use environment of a reactor and the highest possible temperature (for example, about 150° C.) when the coil is excited. As a result, it was found that the following phenomenon occurs when the temperature of the reactor decreases, although no problem occurs when the temperature is increased.

(1) Cracking occurs at the resin portion that is interposed between the internal core portion and the coil (hereinafter, a region interposed between the internal core portion and the coil will be referred to as the interposed region, and the resin portion in the interposed region will be referred to as the interposed resin portion).

(2) When only the coil, without the internal core portion, is molded with a resin portion and only the molded product is subjected to the thermal cycle test, cracking does not occur at the resin portion of the molded product on the inner peripheral side of the coil.

The reason for this phenomenon was considered as follows: because the internal core portion has a coefficient of linear expansion lower than that of the resin portion, contraction of the resin portion is inhibited by the presence of the internal core portion when the temperature of the reactor decreases and an excessive stress acts on the interposed resin portion, and thereby cracking occurs. The present invention is achieved on the basis of this finding, and achieves the object described above by using a cushioning member that reduces the stress that acts on the interposed resin portion when the temperature of the reactor decreases.

A reactor according to the present invention includes a coil and a core, the coil being formed by helically winding a wire, the core including an internal core portion and a couple core portion, the internal core portion being disposed inside the coil and forming a part of a closed magnetic path, and the couple core portion being joined to the internal core portion and forming a remaining part of the closed magnetic path. The reactor is characterized by including a resin portion including a region (interposed region) that is interposed between the coil and the internal core portion, and a cushioning member that is interposed between the resin portion in the region (interposed resin portion) and the internal core portion and that reduces a stress that acts on the resin portion in the region.

With this configuration, because the cushioning member is disposed between the interposed resin portion and the internal core portion, contraction of the interposed resin portion is less inhibited by the internal core portion when the temperature of the reactor decreases. Therefore, cracking of the interposed resin portion can be effectively prevented.

As an embodiment of the reactor according to the present invention, it is preferable that a material of the cushioning member has a Young's modulus that is smaller than that of a resin material of the resin portion.

With this configuration, the cushioning member can reliably function as a cushion that prevents an excessive stress from acting on the interposed resin portion.

As an embodiment of the reactor according to the present invention, the resin portion may be an external resin portion that covers at least a part of an assembly including the coil and the core.

With this configuration, when a part of the external resin portion is the interposed resin portion, cracking of the interposed resin portion can be prevented due to the presence of the cushioning member. Because the assembly including the coil and the core is covered by the external resin portion, the assembly in the reactor can be sufficiently protected mechanically and electrically.

As an embodiment of the reactor according to the present invention, the resin portion may be an internal resin portion that retains a shape of the coil.

With this configuration, because the internal resin portion retains the shape of the coil, the coil can be handled as a member that does not extend and contract and that has a stable shape. In particular, because the internal resin portion integrates the coil, the internal core portion, and the cushioning member with each other, these members can be handled as a unit, and thereby ease of assembly of the reactor can be improved. A combination of the coil and the core, which is molded with the internal resin portion, may be covered by the external resin portion.

As an embodiment of the reactor according to the present invention, a resin material of the resin portion may be an epoxy resin.

With this configuration, because an epoxy resin, which has a relatively high rigidity and high heat conductivity, is used as a resin material of the resin portion, the coil and the core are sufficiently protected by the epoxy resin and the reactor has a high heat dissipation efficiency. Moreover, because the epoxy resin has a high insulation ability, the coil and the core can be reliably insulated from each other by molding the core with the epoxy resin.

As an embodiment of the reactor according to the present invention, the cushioning member may be at least one of a heat shrinkable tube, a cold shrinkable tube, a mold layer, a coating layer, and a tape-wound layer.

If the cushioning member is a heat shrinkable tube, the cushioning member can reliably cover the outer peripheral surface of the internal core portion along the outer peripheral surface, and coming off of the cushioning member from the internal core portion can be prevented. If the cushioning member is a cold shrinkable tube, the internal core portion can be covered by the cushioning member by fitting the cold shrinkable tube onto the outer periphery of the internal core portion without heating the tube. If the cushioning member is a mold layer, a cushioning member having a highly uniform thickness can be easily formed by molding the outer peripheral surface of the internal core portion. In particular, in the case of a mold layer, a resin having poor a heat-shrinkable or cold-shrinkable characteristic may be used as a resin material of the cushioning member, so that the material of the cushioning member can be selected from a variety of materials. If the cushioning member is a coating layer, the internal core portion can be covered by the cushioning member by performing a simple operation, such as applying the material of the cushioning member to the outer periphery of the internal core portion. If the cushioning member is a tape-wound layer, the outer periphery of the internal core portion can be easily covered by the cushioning member by winding tape around the outer periphery of the internal core portion.

As an embodiment of the reactor according to the present invention, the coil may include a single coil element, the internal core portion may be a rod-like core member that is inserted into the coil element, and the couple core portion may be an external core member that is coupled to an end of the internal core portion and that is disposed outside the coil element.

With this configuration, a small reactor can be realized by forming a so-called pot-shaped-core reactor in which substantially the entire periphery of a coil is covered by a couple core portion, a reactor having a core with an E-E-shaped cross section, a reactor having a core with an E-I-shaped cross section, a reactor having a core with a T-U-shaped cross section, or the like.

As an embodiment of the reactor according to the present invention, the coil may include a pair of coil elements that are coupled in parallel with each other, the internal core portion may a pair of middle core members each of which is inserted into a corresponding one of the coil elements, and the couple core portion may be a pair of end core members that are disposed at ends of the middle core members so as to form an annular core by connecting the pair of middle core members to each other.

With this configuration, because the reactor includes the annular core and the pair of parallelly disposed coil elements (hereinafter, a reactor having this configuration may be referred to as a toroidal reactor), a reactor having a sufficiently large number of turns and a small size can be formed.

As an embodiment of a toroidal reactor according to the present invention, the reactor further includes an external resin portion that covers at least a part of an assembly including the coil and the core. In this case, each core member may include a chamfered corner portion at a ridge formed by an inner end surface and an adjacent surface that is connected to the inner end surface, the inner end surface facing an end surface of the coil.

With this configuration, because the chamfered corner portion is formed at a ridge formed by an inner surface of the end core member, which faces an end surface of the coil, and an adjacent surface that is connected to the inner end surface, the resin material of the external resin portion can be guided into a space between the core and the coil by using the chamfered corner portion. Therefore, the space can be more sufficiently filled with the resin material, and formation of holes between the core and the coil can be prevented. The chamfered corner portion can also prevent the couple core portion and other members assembled with the couple core portion from being damaged during assembly of the reactor or in other occasions. When the couple core portion is being conveyed, the couple core portion may be handled by a manipulator or may contact other members. In such a case, chipping or the like of the corners of the couple core portion can be prevented by forming the chamfered corner portions. Moreover, because the ridge is chamfered and does not have sharp corners, insulation coating of the coil is not likely to be damaged even if the couple core portion contacts the coil.

As an embodiment of the reactor according to the present invention, the chamfered corner portion may be formed by rounding the ridge.

With this configuration, because the ridge formed by the inner end surface and the adjacent surface is rounded, the chamfered corner portion has a shape that follows the shape of the ridge formed by the inner end surface and the adjacent surface and that allows the resin material of the external resin portion to easily flow around the chamfered corner portion. Therefore, the resin material can be easily introduced into a space between the core and the coil from the chamfered corner portion. Moreover, because the chamfered corner portion is formed by rounding the ridge, damage to the couple core portion during assembly of the reactor as described above can be more easily prevented.

As an embodiment of the reactor according to the present invention, at least one of surfaces of each end core member, the surfaces being opposite to each other in a direction in which the reactor is mounted, may protrude further than at least one of surfaces of the internal core portion, the surfaces being opposite to each other in the direction in which the reactor is mounted.

With this configuration, because a specific surface of the end core member (usually, the upper or lower surface) protrudes further than the internal core portion in a direction perpendicular to the specific surface (a core of this type will be referred to as a 3D core), the length of the end core member in the coil axis direction (thickness of the end core member) can be reduced and the projected area of the reactor in plan view can be reduced. On the other hand, because the specific surface of the end core member protrudes, a region of the inner end surface that faces an end surface of the coil has a large area, and a gap between the core and the coil near the end surface of the coil is blocked. As a result, it becomes difficult to fill a space between the core and the coil with the resin material. Therefore, in the case of a 3D core, forming a chamfered corner portion at the ridge formed by the inner end surface and the adjacent surface is particularly effective in smoothly filling the space with the resin material.

As an embodiment of the reactor according to the present invention, the adjacent surface of the end core member may be a side surface that is adjacent to the inner end surface.

With this configuration, filling with the resin material can be easily performed through a space between the side surface of the end core member and the end surface of the coil. Moreover, decrease in the area of a magnetic path formed in the core when the coil is excited, which may occur due to the presence of the chamfered corner portion, can be avoided. In particular, when the end core member is made from a powder molded product, the direction along the ridge formed by the inner end surface and the side surface can be made to correspond to the direction in which the end core member is removed from the mold. If the chamfered corner portion is formed at the ridge, the ridge does not have an acute angle, and therefore the end core member can be easily removed from the mold.

As an embodiment of the reactor according to the present invention, the adjacent surface of the end core member may be an upper surface that is adjacent to the inner end surface, and the chamfered corner portion may be formed so as to face a portion of the end surface of the coil at which wires of the coil elements are disposed side by side and in parallel with each other.

With this configuration, filling with the resin material can be easily performed through a space between the upper surface of the end core member and the end surface of the coil. Moreover, decrease in the area of a magnetic path formed in the core when the coil is excited due to the presence of the chamfered corner portion can be avoided. In particular, even if the core is configured so that a specific surface (usually, an upper or lower surface) of the end core member is flush with a specific surface of the internal core portion (a core of this type will be referred to as a flat core), a space between the coil elements can be easily filled with the resin material because the chamfered corner portion is formed so as to face a position on the end surface of the coil at which wires of the coil elements are disposed side by side and in parallel with each other.

As an embodiment of the reactor according to the present invention, the reactor may further include an internal resin portion that retains the shape of the coil, and the external resin portion may cover at least a part of an assembly including the core and the coil provided with the internal resin portion.

With this configuration, because the internal resin portion retains the shape of the coil, the coil can be handled as a member that does not extend and contract, and thereby productivity of the reactor can be improved. Moreover, because the coil and the core have portions that are doubly covered by the internal resin portion and the external resin portion, the coil and the core can be sufficiently protected mechanically and electrically. Because the chamfered corner portion is formed, a space between the inner end surface of the end core member and a surface of the internal resin portion on the coil end surface side can be reliably filled with the resin material of the external resin portion.

As an embodiment of the reactor according to the present invention, the reactor may include an internal resin portion that covers at least a part of the coil and retains the shape of the coil, and an external resin portion that covers at least a part of an outer periphery of an assembly including the core and the coil provided with the internal resin portion. In this case, the reactor may include a positioning portion that is integrally formed with the internal resin portion. This positioning portion is used to position the assembly with respect to a mold when forming the external resin portion by using the mold, and is not covered by the external resin portion.

With this configuration, because the coil is covered by the internal resin portion and the shape of the coil is retained by the internal resin portion, the coil does not extend and contract during assembly of the reactor, and thereby the coil can be handled easily and the reactor has a high productivity. Moreover, because the internal resin portion can increase insulation between the core and the coil and can retain the coil in a compressed state, the number of components and the number of production steps of the reactor can be reduced by omitting a sleeve-like bobbin, a frame-like bobbin, and an inner case. Also in this respect, the reactor having the configuration described above has a high productivity. Furthermore, the configuration described above is provided with a positioning portion that is integrally formed with the internal resin portion, so that positioning of the assembly with respect to the mold can be easily performed by only fitting the positioning portion into the mold and the determined position of the assembly can be reliably maintained. Therefore, with the configuration described above, an independent support member for positioning is not necessary, a step for disposing such a member is not necessary, and therefore the reactor has a high productivity also in this respect. Moreover, due to the fitting operation described above, the assembly can be reliably held in the mold at the predetermined position, and thereby the external resin portion can be formed with high precision.

In addition, with the configuration described above, because the positioning portion is disposed in the internal resin portion itself, the coil and the core do not have exposed portions (contact portions with the support member) that are not covered by the external resin portion, which may be formed if an independent support member is used. That is, with the configuration described above, the coil and the core are substantially covered by the internal resin portion and the external resin portion, and thereby mechanical protection (strength and the like) and protection against the external environment (corrosion, dust, and the like) can be sufficiently provided. Moreover, the positioning portion is formed from the internal resin portion, although the positioning portion is not covered by the external resin portion and exposed. Therefore, even if a part of the coil is present in the resin material of the positioning portion, the part is covered by the internal resin portion, and thereby mechanical protection of the coil and protection of the coil against the external environment can be provided.

As an embodiment of a toroidal reactor according to the present invention, the coil may include a couple portion that couples the pair of coil elements to each other, the couple portion may protrude further than turn-formed faces of the pair of coil elements, and the positioning portion may be formed in the internal resin portion at a position at which the internal resin portion covers the couple portion.

When the couple portion protrudes further than the turn-formed face and the internal resin portion is formed so as to follow this shape, a portion of the internal resin portion with which the couple portion is covered (hereinafter, referred to as a couple portion covering portion) protrudes further than the other portions of the internal resin portion. By using at least a part of the couple portion covering portion as a positioning portion, a recess for forming a couple portion covering portion in a mold for molding the internal resin portion can be used also as a recess for forming the positioning portion, and therefore it is not necessary to independently form a recess for forming the positioning portion in the mold. Moreover, because the couple portion covering portion itself is the positioning portion, an independent protrusion that serves as the positioning portion is not present, and therefore the reactor has a good outer shape.

As an embodiment of the reactor according to the present invention, the core may have one of the following compositions (1) to (4):

(1) both of the internal core portion and the couple core portion are molded products of magnetic powder;

(2) both of the internal core portion and the couple core portion are laminated structures of magnetic plates;

(3) the internal core portion is a laminated structure of magnetic plates and the couple core portion is a molded product of magnetic powder; and (4) the internal core portion is a molded product of magnetic powder and the couple core portion is a molded product of a mixture of magnetic powder and resin.

If both the internal core portion and the couple core portion are molded products, a core having a complex three-dimensional shape can be easily formed. If both the internal core portion and the couple core portion are laminated structures, a core having a high magnetic permeability and a high saturation flux density can be easily formed, and a core having a high mechanical strength can be easily formed. If the internal core portion is a laminated structure and the couple core portion is a molded product, a core having a high saturation flux density can be easily formed because the internal core portion is a laminated structure. Moreover, because the couple core portion is a molded product, the inductance of the entirety of the core can be easily adjusted and a core having a three-dimensional shape with protrusions and recess can be easily formed. If the internal core portion is a molded product of magnetic powder and the couple core portion is a molded product of magnetic powder and a resin, a pot-shaped-core reactor, a reactor having a core with an E-E-shaped cross section, a reactor having a core with an E-I-shaped cross section, a reactor having a core with a T-U-shaped cross section, or the like can be easily formed by filling a space surrounding the internal core portion with the mixture and by hardening the resin.

A reactor component according to the present invention includes a coil and a core, the coil being formed by helically winding a wire, the core including a couple core portion that is disposed not inside the coil and that forms a part of a closed magnetic path. The reactor component is characterized by including an internal core portion that is disposed inside the coil and that forms the remaining part of the closed magnetic path, a cushioning member that covers at least a part of an outer periphery of the internal core portion, and an internal resin portion that integrates the coil with the internal core portion covered by the cushioning member and that retains the shape of the coil.

With this configuration, cracking of the interposed resin portion, which is a part of the internal resin portion, can be prevented due to the presence of the cushioning member. Moreover, because the internal resin portion integrates the coil, the internal core portion, and the cushioning member with each other, these members can be handled as a unit, and thereby ease of assembly of the reactor can be improved.

As an embodiment of the reactor component according to the present invention, a material of the cushioning member may have a Young's modulus that is smaller than that of a resin material of the internal resin portion.

With this configuration, the cushioning member reliably has a function of a cushion that prevents an excessive stress from acting on the interposed resin portion.

Advantageous Effects of Invention

With the reactor and the reactor component according to the present invention, cracking of the interposed resin portion due to a thermal cycle can be prevented because the cushioning member is disposed adjacent to the resin portion in the interposed region between the coil and the internal core portion.

DESCRIPTION OF EMBODIMENTS

Figure 1:
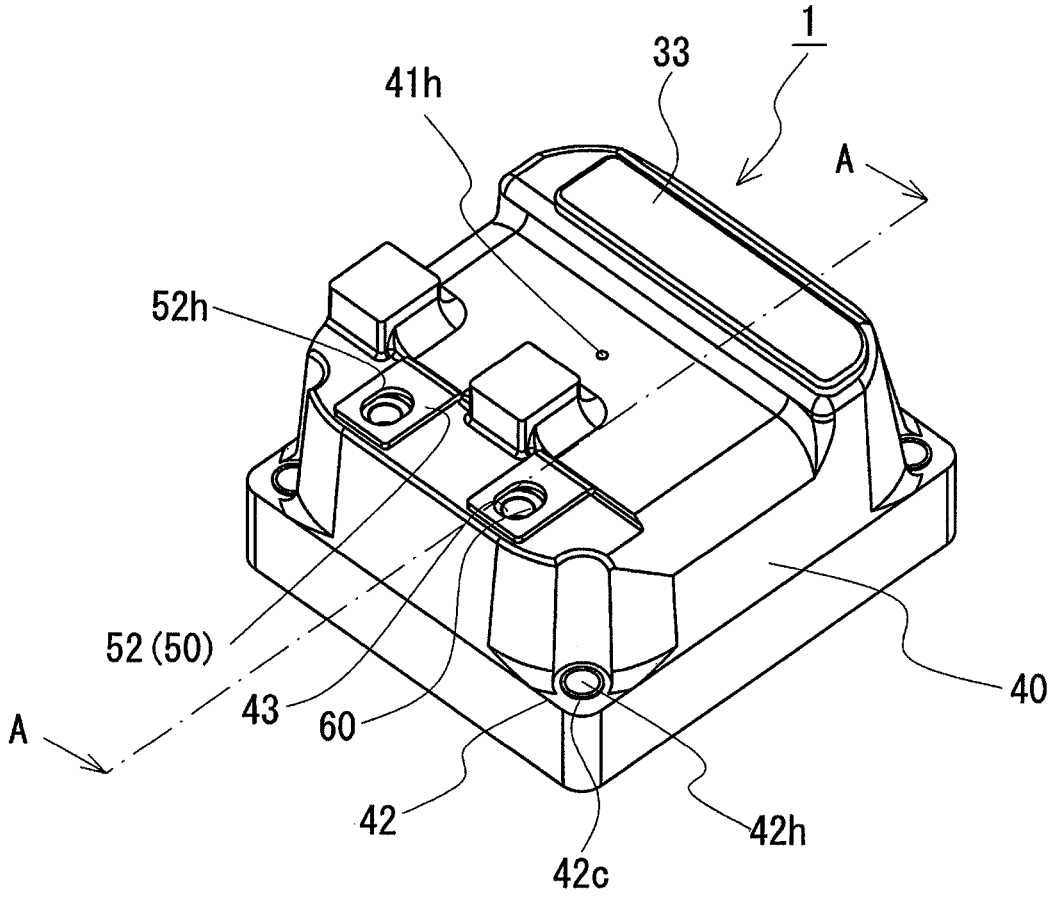
FIG. 1 is an external perspective view of a reactor according to a first embodiment.

Hereinafter, embodiments of the present invention will be described with reference to the drawings. In the drawings, the same components or the corresponding components are denoted by the same numerals.

First Embodiment

Referring to FIGS. 1 to 7, a reactor according to a first embodiment of the present invention will be described. The reactor according to the present embodiment is a toroidal-type reactor.

Figure 2:
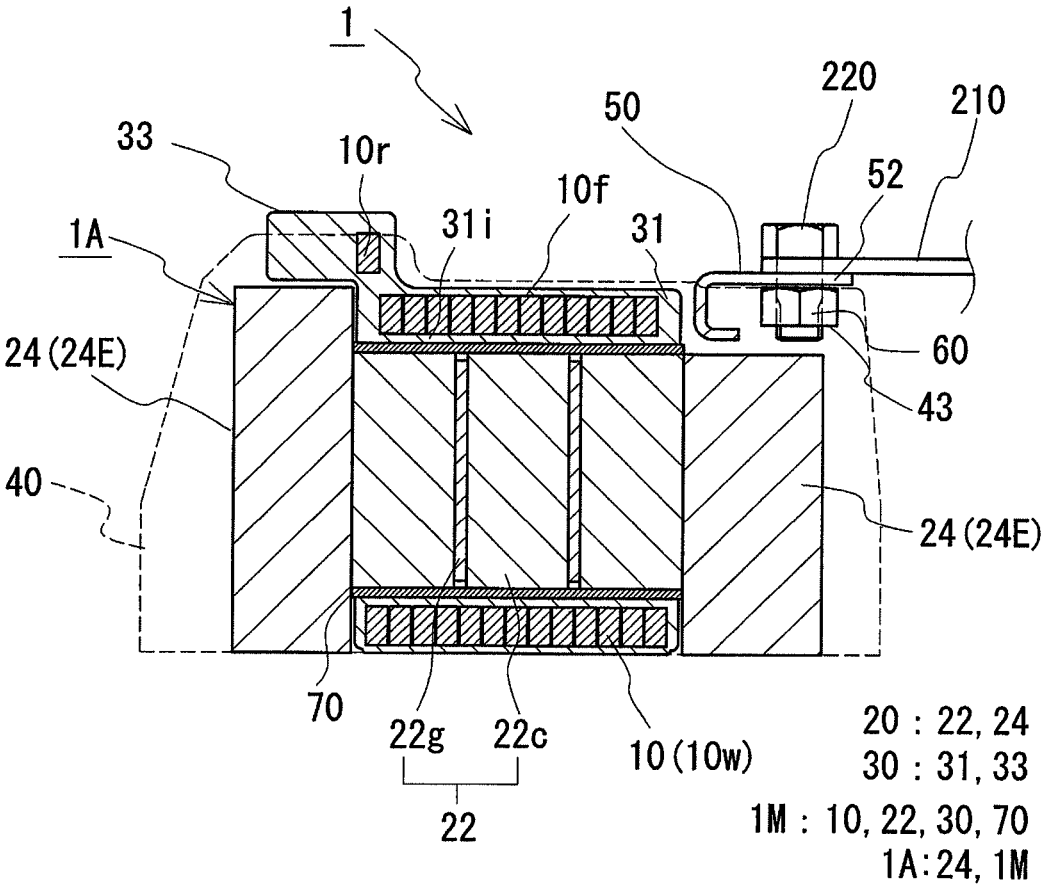
FIG. 2 is a sectional view taken along line A-A of FIG. 1.

A reactor 1 is formed by covering an assembly 1A by an external resin portion 40 (FIGS. 1 and 2). The assembly 1A includes a coil molded product 1M (FIGS. 2, 4(B), and 5), in which a coil 10 and a part of an annular core 20 are integrally molded with an internal resin portion 30, and the remaining part of the core 20. The core 20 includes internal core portions 22 (FIGS. 2 to 4) and a pair of end core members 24E. The internal core portions 22 are fitted into the coil 10. The end core members join the end surfaces of the internal core portions 22 to each other and are exposed from the coil 10. The end core members 24E constitute couple core portions 24 (FIGS. 2 and 5). Moreover, metal terminals 50 are integrally molded with the external resin portion 40, and nut accommodating holes 43 are formed therethrough. Nuts 60 that are fitted into the nut accommodating holes 43 and the metal terminals 50 constitute a terminal base (FIG. 1).

The reactor 1 is used, for example, as a component of a DC-DC converter of a hybrid vehicle. In this case, a flat lower surface of the reactor 1 (the lower surface in FIG. 2) is directly placed on a cooling base (mount object), which is not shown.

The most important feature of this reactor is that a cushioning member 70 is disposed on the outer peripheral surface of each of the internal core portions 22 between the coil 10 and the internal core portion 22 as illustrated in FIG. 2, and thereby cracking of a portion (interposed resin portion 31*i*) of the internal resin portion 30 interposed between the cushioning member 70 and the coil 10 is prevented even when the reactor is subjected to a thermal cycle. Hereinafter, regarding the reactor 1 and the components thereof, a side of the reactor 1 facing a direction in which the reactor 1 is mounted onto a cooling base will be referred to as the lower side, and the opposite side will be referred to as the upper side.

[Coil Molded Product]

As illustrated in FIGS. 2 and 4(B), the coil molded product 1M of the reactor 1 includes the coil 10, the internal resin portion 30 that covers most of the outer periphery of the coil 10, the internal core portions 22 described below, and the cushioning members 70.

<<Coil>>

The coil 10 includes a pair of coil elements 10A and 10B that are formed by helically winding a wire 10*w* (FIG. 4(A)). The coil elements 10A and 10B have the same number of turns, have substantially rectangular shapes when seen in the axial direction, and are arranged side by side so that the axial directions thereof are parallel to each other. These coil elements 10A and 10B are made from a single wire having no joint. That is, at one end of the coil 10, one end 10*e* and the other end 10*e* of the wire 10*w* are drawn out upward. At the other end of the coil 10, the coil elements 10A and 10B are coupled to each other through a couple portion 10*r* that is formed by bending the wire 10*w* into a U-shape. With such a configuration, the winding directions of the coil elements 10A and 10B are the same. The couple portion 10*r* may be formed by, for example, connecting ends of a pair of coil elements, which are made from independent wires, by welding the ends via a coupling conductor. In the present embodiment, the couple portion 10*r* protrudes further outward and upward than turn-formed faces 10*f* at the top of the coil elements 10A and 10B. The ends 10*e* of the coil elements 10A and 10B are drawn out upward from turn portions 10*t* and connected to the metal terminals 50 (FIG. 1), through which electric power is supplied to the coil elements 10A and 10B.

An insulated rectangular wire, which is a rectangular copper wire coated with enamel, is used as the wire 10*w* of the coil elements 10A and 10B. The insulated rectangular wire is wound edgewise so as to form the coil elements 10A and 10B each having a hollow rectangular tube-like shape. Other than a wire having a rectangular conductor, a wire having any other shape, such as that having a circular cross section or a polygonal cross section, may be used. By using a rectangular wire, a coil having a higher space factor can be more easily formed than by using a round wire.

<<Internal Resin Portion>>

Figure 4:
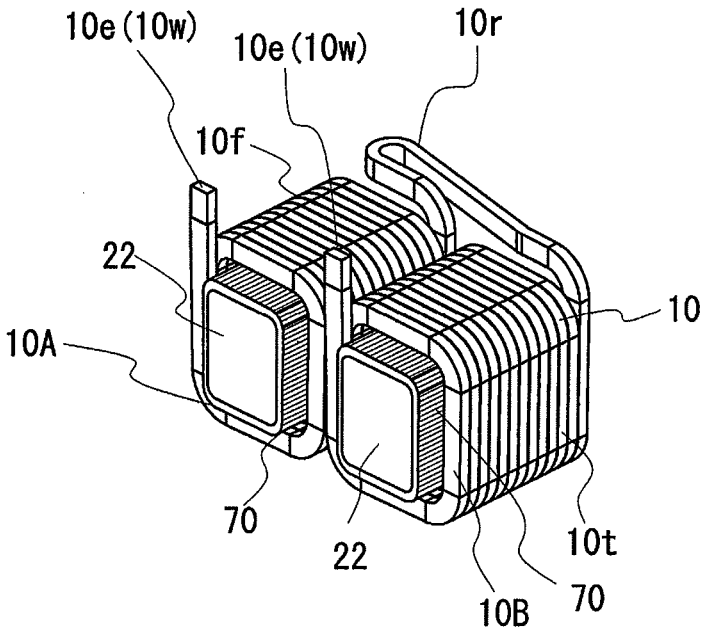
FIG. 4 illustrates steps of assembling the reactor according to the first embodiment, FIG. 4(A) illustrating a state in which the internal core portions provided with the cushioning members are combined with coils, and FIG. 4(B) illustrating a state in which the internal core portions and the coils illustrated in FIG. 4(A) are molded with an internal resin portion.
Figure 4:
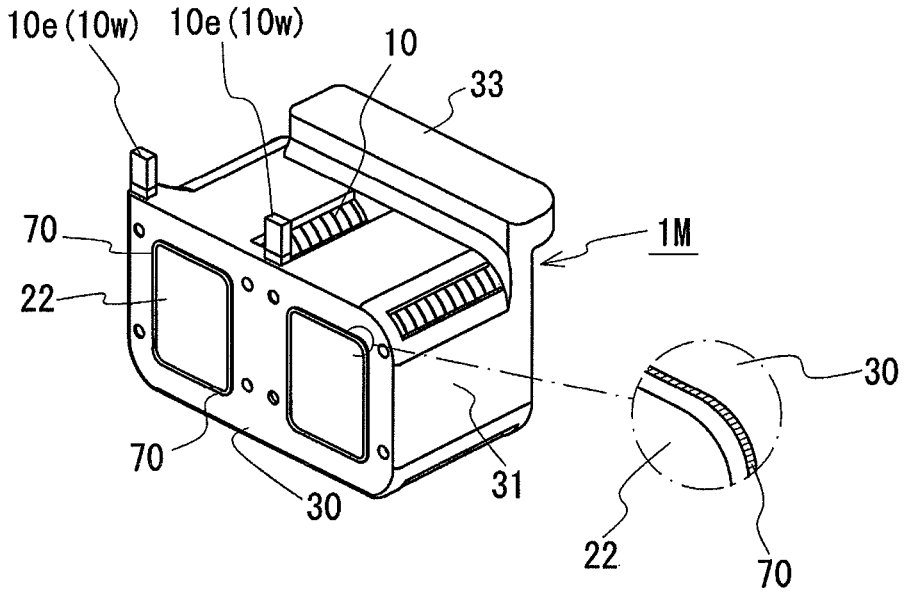
Figure 5:
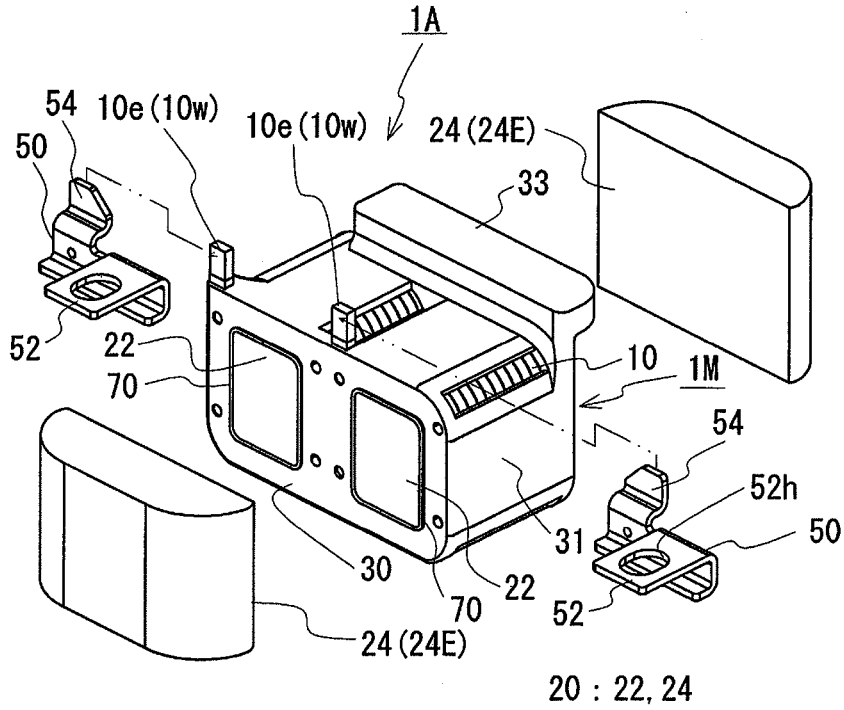
FIG. 5 illustrates steps of assembling the reactor according to the first embodiment, illustrating a state in which couple core portions and metal terminals are being combined with a reactor component.

The internal resin portion 30, which retains the coil 10 in a compressed state, is formed on the outer periphery of the coil 10 (FIGS. 2 and 4). The internal resin portion 30 includes a turn covering portion 31 and a couple portion covering portion 33. The turn covering portion 31 covers the turn portions 10*t* of the coil elements 10A and 10B so as to substantially follow the outer shape of the coil elements 10A and 10B. The couple portion covering portion 33 covers the outer periphery of the couple portion 10*r*. The turn covering portion 31 and the couple portion covering portion 33 are integrally molded, and the turn covering portion 31 covers the coil 10 with a substantially uniform thickness. In the present embodiment, the coil 10 and the internal core portions 22 provided with the cushioning members 70 are integrated with each other with the internal resin portion 30. The interposed resin portions 31*i* of the turn covering portions 31, which are interposed between the cushioning members 70 and the coil 10, have a substantially uniform thickness. However, the corners of the coil elements 10A and 10B and the ends 10*e* of the wire are exposed to the outside from the internal resin portion 30. The turn covering portions 31 mainly have a function of providing insulation between the coil elements 10A and 10B and the internal core portions 22, and have a function of positioning the internal core portions 22 provided with the cushioning member 70 with respect to the coil elements 10A and 10B.

The couple portion covering portion 33 has a function of mechanically protecting the couple portion 10*r* when forming the external resin portion 40 (FIGS. 1 and 2) on the outer periphery of the assembly 1A (FIG. 2). Moreover, at least a part of the couple portion covering portion 33 functions as a positioning portion for positioning the assembly 1A with respect to a mold 100 (FIG. 7) when forming the external resin portion 40 (FIGS. 1 and 2) on the outer periphery of the assembly 1A including the coil molded product 1M and the core 20. Here, as illustrated in FIG. 4(B), the couple portion covering portion 33 has a rectangular parallelepiped shape that covers the entirety of the U-shaped couple portion 10*r*. However, the shape of the couple portion covering portion 33 is not particularly limited and may be a shape that follows the shape of the U-shaped couple portion 10*r*. As illustrated in FIGS. 1 and 2, the positioning portion of the rectangular-parallelepiped-shaped couple portion covering portion 33 (which looks like a rectangular plate in FIG. 1) is not covered by the external resin portion 40, and the positioning portion is exposed to the outside.

A sensor-use hole 41*h*, which is not shown, for housing a temperature sensor (for example, a thermistor) is formed in the internal resin portion 30 between the coil elements 10A and 10B (FIG. 1). Here, a part of a sensor storing pipe (not shown) is insert-molded into the internal resin portion 30, and the remaining part of the sensor storing pipe is covered by the external resin portion 40, and thereby the sensor-use hole 41*h* is formed. The sensor storing pipe protrudes slightly from the turn covering portion 31 of the internal resin portion 30, which covers the turn portions 10*t* of the coil.

A material that can be preferably used as the resin material of the internal resin portion 30 is a material that has heat resistance to the extent that the material does not soften at the highest possible temperature that the coil or the core may reach while the reactor 1 including the coil molded product 1M is used and that can be subjected to transfer molding and injection molding. In particular, it is preferable to use a material having a high insulation ability. To be specific, a thermosetting resin such an epoxy resin, a polyphenylene sulfide (PPS) resin, or a thermoplastic resin such as liquid crystal polymer (LCP) can be preferably used. Here, an epoxy resin is used. The heat dissipation efficiency of the resin can be improved by mixing at least one of ceramic fillers that is selected from silicon nitride, alumina, aluminium nitride, boron nitride, and silicon carbide.

[Core]

The core 20 is an annular member that forms an annular magnetic path when the coil 10 is excited. The core 20 includes a pair of middle core members (internal core portions 22), which are fitted into the coil elements 10A and 10B, and the pair of end core members 24E (couple core portions 24) that are exposed from the coil 10.

Figure 3:
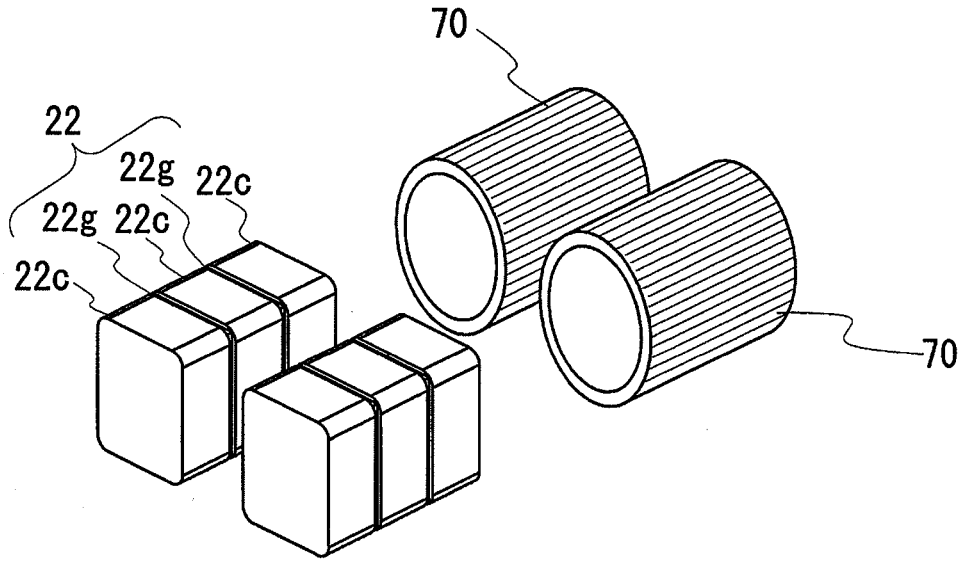
FIG. 3 illustrates steps of assembling the reactor according to the first embodiment, FIG. 3(A) illustrating a state before cushioning members are attached to internal core portions, and FIG. 3(B) illustrating a state after the cushioning members have been attached to the internal core portions.
Figure 3:
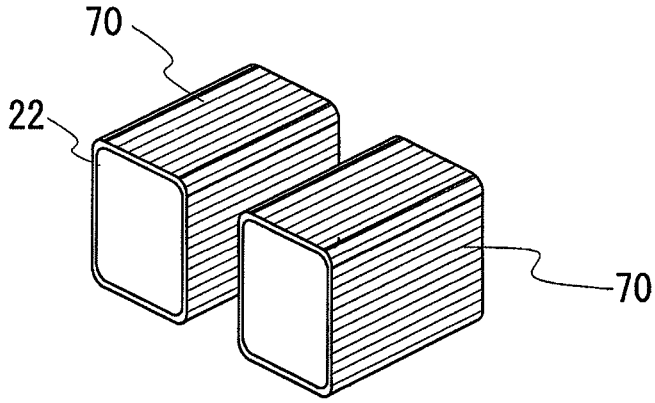

Each of the internal core portions 22 of the core 20 is a member having a substantially rectangular parallelepiped shape. As illustrated in FIGS. 2 and 3, each of the internal core portions 22 includes core pieces 22*c* and gap members 22*g*, which are alternately arranged and joined to each other with an adhesive. The core pieces 22*c* are made of a soft magnetic material such as iron or steel, and the gap members 22*g* are made of a non-magnetic material such as alumina. As each of the core pieces 22*c*, a laminated structure including a plurality of thin magnetic plates each having an insulation coating or a molded product of magnetic powder can be used. Examples of the thin magnetic plates include thin plates made of an amorphous magnetic material, permalloy, silicon steel, and the like. Examples of the molded product include a molded product of magnetic powder made of an iron group metal, such as Fe, Co, and Ni, or an amorphous magnetic material; a sintered product made by sintering press-molded magnetic powder; a hardened molded product that is formed by molding a mixture of magnetic powder and a resin; and a ferrite core that is a sintered product of a metal oxide. Here, a powder molded product of soft magnetic powder is used. The gap members 22*g* are plate-like members disposed between the core pieces 22*c* to adjust the inductance. The number of the core pieces 22*c* and the number of the gap members 22*g* may be appropriately selected so that the reactor 1 may have a desired inductance. The shapes of the core pieces 22*c* and the gap members 22*g* may be appropriately selected. Both end surfaces of each of the internal core portions 22 protrude slightly from end surfaces of the internal resin portion 30.

The couple core portions 24 are block-like members that are made of a material the same as that of the core pieces 22*c*. Here, the end core members 24E, each of which is a powder molded product of soft magnetic powder and has a substantially trapezoidal cross section, are used.

The couple core portions 24 are disposed so as to connect the ends of the pair of parallelly arranged internal core portions 22, and are joined to the internal core portions 22 by using an adhesive. The core 20, which has a closed-loop-like (annular) shape, is formed by joining the internal core portions 22 and the couple core portions 24 to one another. In a state in which the internal core portions 22 and the couple core portions 24 are joined to one another, the side surfaces of the couple core portions 24 protrude further outward than the outer side surfaces of the internal core portions 22.

As illustrated in FIG. 2, the end core members 24E have different heights. The upper and lower surfaces of one of the end core members 24E disposed below the couple portion covering portion 33 (on the left side in FIG. 2) protrude further upward and downward than the upper and lower surfaces of each of the internal core portions 22 and are substantially flush with the upper and lower surfaces of each of the turn covering portions 31. In contrast, the lower surface of the other end core member 24E disposed near the ends 10*e* of the wire (on the right side in FIG. 2) protrudes further downward than the lower surface of the internal core portion 22 and is substantially flush with the lower surface of the turn covering portion 31, but the upper surface of the end core member 24E is substantially flush with the upper surface of the internal core portion 22 and is lower than the upper surface of the turn covering portion 31. On the other hand, the one of the end core members 24E has a thickness (dimension in the coil axis direction) that is smaller than that of the other of the end core members 24E. That is, the end core members 24E have substantially the same volume although their heights and thicknesses are different, so that the end core members 24E have substantially the same magnetic characteristics. Moreover, because the couple portion 10*r* are disposed above the turn-formed faces 10*f* (FIG. 4), the one of the end core members 24E, which is thinner than the other of the end core members 24E, can be disposed below the couple portion covering portion 33, and thereby the projected area of the reactor can be reduced. It is preferable that the lower limit of the height of the end core member 24E be about a height at which the upper surface of the end core member 24E is flush with the upper surface of the internal core portion 22. The is because, if the upper surface of the end core member 24E is lower than the upper surface of the internal core portion 22, it may happen that a sufficient magnetic path is not be formed along the course from the internal core portion 22 to the end core member 24E.

When the core 20 has been assembled in an annular shape, the lower surfaces of the couple core portions 24 are substantially flush with the lower surface of the coil molded product 1M on the mount surface side. With such a configuration, when the reactor 1 is fixed to the cooling base, not only the internal resin portion 30 but also the couple core portions 24 are in contact with the cooling base, and thereby heat generated during operation of the reactor 1 can be efficiently dissipated.

[Cushioning Member]

The cushioning members 70 have the function of preventing an excessive stress from acting on the interposed resin portions 31*i*. Such a stress is generated if contraction of the internal resin portion is inhibited by the internal core portions 22 when the reactor is subjected to a thermal cycle and temperature decreases.

The cushioning members 70 are formed on the outer peripheral surfaces of the internal core portions 22. Because the cushioning members 70 are disposed on the outer peripheral surfaces of the internal core portions 22, when the reactor is subjected to a thermal cycle, an excessive stress is efficiently prevented from acting on the interposed resin portions 31*i*, which are located between the internal core portions 22 and the coil 10. The cushioning members 70 may be sheet-like members that cover the entire outer peripheral surfaces of the internal core portions 22, or may be mesh-like or grid-like members that partially and substantially uniformly cover the outer peripheral surfaces. However, the outer peripheral surfaces of the couple core portions 24 are not covered by the cushioning members 70. Because the couple core portions 24 are not covered by the cushioning members 70, a high heat dissipation efficiency of the reactor is maintained.

It is preferable that the resin material of the cushioning members 70 be a material having a Young's modulus that is smaller than that of the internal resin portion 30. If the cushioning members 70 are made of such a material, the cushioning members 70 function as a cushion by being elastically deformed when the internal resin portion 30 contracts, and thereby prevent cracking of the interposed resin portions 31*i*. In the present embodiment, a heat shrinkable tube made by Sumitomo Electric Fine Polymer Corporation, such as "Sumitube K" or "Sumitube B2", is used as the cushioning members 70 ("Sumitube" is a registered trademark). "Sumitube K" contains polyvinylidene fluoride (PVDF) as the base resin, and "Sumitube B2" contains polyolefin resin as the base resin. The Young's modulus of such a heat shrinkable tube is smaller than about 3.0 GPa, while the Young's modulus of epoxy resin is in the range of about 3.0 to 30 GPa. The material of the cushioning members 70 preferably has a Young's modulus in the range of about 0.5 to 2 GPa.

It is preferable that the material of the cushioning members 70 have heat-resistant and cold-resistant characteristics the same as those of the resin material of the internal resin portion 30. The continuously usable temperature range of "Sumitube K" is −55 to 175° C., and the continuously usable temperature range of "Sumitube B2" is −55 to 135° C. It is also preferable that the material of the cushioning members 70 have an insulation ability. Usually, the wire 10*w* has an insulation coating such as enamel, so that it is not necessary to make the cushioning members 70 from an insulating material. Theoretically, the cushioning members 70 may be made of a conductor or a semiconductor. However, with consideration of a case where pin holes are formed in the enamel, insulation between the coil 10 and the internal core portions 22 can be reliably maintained by forming the cushioning members 70 from an insulation material. In this respect, both "Sumitubes" described above have high insulation abilities. Alternatively, a heat shrinkable tube made of a fluororesin (for example, PTFE whose usable temperature is about 260° C.) or a frame-resistant polyvinyl chloride (PVC whose usable temperature is about 200° C.) may be used as the cushioning members 70 due to the heat resistance and the insulation ability thereof.

Further alternatively, the shapes and the method of forming the cushioning members 70 may be different from those of the heat shrinkable tube. First, a cold shrinkable tube may be used. A cold shrinkable tube is made of a material having high extension and contraction abilities. To be specific, a cold shrinkable tube made of a silicone rubber (VMQ or FVMQ, whose usable temperature is 180° C.) may be used. Alternatively, butyl rubber (IIR), ethylene-propylene rubber (EPM, EPDM), Hypalon (registered trademark, and generic name is chlorosulphonated polyethylene rubber, CSM), acrylic rubber (ACM, ANM), and fluorocarbon rubber (FKM) may be used. These materials are preferable because the usable temperature of these materials is equal to or higher than 150° C. and these materials each have a high insulation ability with a volume resistivity equal to or higher than $10^{10}$ Ω·m. The cold shrinkable tube is attached to the internal core portion 22 due to contraction of the tube itself. To be specific, a cold shrinkable tube having an outer perimeter larger than that of the internal core portion 22 is prepared, and the tube is expanded in diameter and fitted onto the outer peripheral surface of the internal core portion 22. By releasing expansion in the diameter in this state, the tube contracts and is attached to the outer peripheral surface of the internal core portion. Next, a mold layer that is formed by using a mold may be used as the cushioning member 70. In this case, the internal core portion 22 is retained in the mold in a state in which a gap is formed between the outer peripheral surface of the internal core portion 22 and the inner surface of the mold, a molding material such as a resin is injected into the mold, and thereby a mold layer is formed on the outer peripheral surface of the internal core portion 22. The mold layer may be thin as long as the mold layer has a cushioning ability that can prevent cracking of the interposed resin portion 31*i*. To be specific, an unsaturated polyester or a polyurethane resin may be used as the resin material of the mold layer. Moreover, a coating layer may be used as the cushioning member 70. In this case, a coating layer can be formed by applying or spraying resin slurry to the outer peripheral surface of the internal core portion 22 or by applying powder coating to the outer peripheral surface of the internal core portion 22. To be specific, liquid silicone rubber or the like may be used as the resin material of the coating layer. Furthermore, a tape-wound layer can be used as the cushioning member 70. In this case, the cushioning member 70 may be easily formed by winding a tape member around the outer peripheral surface of the internal core portion 22. Examples of the resin material of the tape member include PET.

In any of the cases, it is more preferable in terms of heat dissipation efficiency that the cushioning member 70 have a smaller thickness, as long as the cushioning member 70 is elastically deformable to an extent that cracking of the interposed resin portion 31*i* can be prevented.

[Metal Terminal and Nut]

Figure 6:
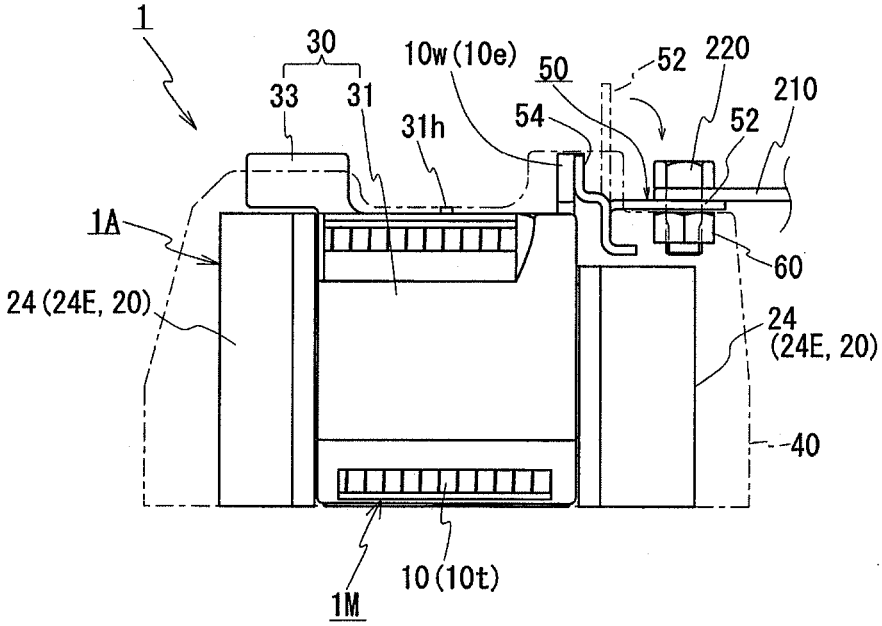
FIG. 6 is a schematic side view of an assembly included in the reactor according to the first embodiment.

Metal terminals 50 are connected to the ends 10*e* of the wire of the coil (FIGS. 1, 5, and 6). Each of the metal terminals 50 includes a connection face 52 to be connected to an electric power supply, a weld face 54 that is welded to one of the ends 10*e* of the wire, and an embedded portion that joins the connection face 52 and the weld face 54 together and that is covered by the external resin portion 40. Most of the metal terminal 50 is embedded in the external resin portion 40, and only the connection face 52 is exposed to the outside from the external resin portion 40 described below. The connection face 52 is disposed above the other couple core portion 24, which has a smaller height. The terminal base is formed by filling a space between the upper surface of the couple core portion 24 and the connection face 52 with the external resin portion 40. Because the metal terminal 50 is disposed above the couple core portion 24 having a smaller height, the height of the reactor including the metal terminal 50 can be made smaller than that of a case where the terminal base is formed by disposing the metal terminal above the coil.

In the terminal base, nuts 60 are disposed below the connection face 52 (FIGS. 1, 2, and 6). Each nut 60 is accommodated in a locked state in a nut accommodating hole 43 molded with the external resin portion 40 described below. Locking is realized by fitting the hexagonal nut 60 into the hexagonal nut accommodating hole 43. The connection face 52 is disposed so as to cover the opening of the nut accommodating hole 43.

The connection face 52 has an insertion hole 52*h* that has an inner diameter smaller than the diagonal length of the nut 60, and the connection face 52 prevents the nut 60 from coming off through the nut accommodating hole 43. When using the reactor, terminals 210 attached to ends of lead wires (not shown) are superposed on the connection face 52, bolts 220 are inserted through the terminals 210 and the connection face 52 and screwed into the nuts 60, and electric power is supplied to the coil 10 from an external equipment (not shown) that is connected to the other ends of the lead wires. In the present embodiment, the height of the connection faces 52 is determined so that, in a state in which the terminals 210 and the bolts 220 are attached to the terminal base, the upper surfaces of the bolts 220 is positioned below a plane that connects the highest portions of the reactor, i.e., the couple portion covering portion 33 of the external resin portion 40 (described below), which covers the couple portion of the coil, to a protection portion of the external resin portion 40, which covers positions at which the ends 10*e* of the wire are welded to the metal terminals 50. Therefore, parts of the heads of the bolts 220 do not protrude from the reactor 1.

[External Resin Portion]

The external resin portion 40 is formed so as to leave the lower surface of the coil molded product 1M and the lower surface of the couple core portion 24 exposed (FIG. 2) and so as to cover most of the upper surface and the entirety of the outer side surface of the assembly including the coil molded product 1M and the couple core portion 24. By leaving the lower surface of the coil molded product 1M and the lower surface of the couple core portion 24 exposed from the external resin portion 40, heat generated in the reactor 1 can be efficiently dissipated to the cooling base. By covering the upper surface and the outer side surface of the assembly 1A by the external resin portion 40, the assembly is mechanically protected.

To be specific, the external resin portion 40 is formed in such a way that the lower surfaces of the couple core portion 24 and the coil molded product 1M (turn covering portion 31) are exposed on the mount-surface-side of the reactor 1 as illustrated in FIG. 2, and the upper surface of the couple portion covering portion 33 is exposed on the upper side of the reactor 1 as illustrated in FIG. 1.

The external resin portion 40 includes flange portions 42 that protrude further outward than the assembly including the coil molded product 1M and the couple core portion 24 in plan view of the reactor (FIG. 1). Through holes 42*h* for inserting bolts (not shown) for fixing the reactor 1 to the cooling base are formed in the flange portions 42. In the present embodiment, metal collars 42*c* are insert-molded into the external resin portion 40, and the inner spaces of the metal collars 42*c* are used as the through holes 42*h*. Brass, steel, stainless steel, and the like may be used as the material of the metal collars 42*c*.

The external resin portion 40 has a protection portion, which covers the joints between the ends 10*e* of the coil and the metal terminals 50, at the upper surface thereof. The protection portion has a substantially rectangular block-like shape. Moreover, the upper surface of the external resin portion 40 is molded so as to be flush with an end of a sensor storing pipe that protrudes from the internal resin portion 30 and the sensor-use hole 41*h* (FIG. 1) is formed.

Side surfaces of the external resin portion 40 are inclined surfaces that widens from the upper portion toward the lower portion of the reactor 1. By forming such inclined surfaces, a molded reactor can be easily removed from the mold when the assembly 1A including the coil molded product 1M and the couple core portions 24 is molded with the external resin portion 40 in a state in which the assembly 1A is inverted.

An unsaturated polyester can be used as the resin material of the external resin portion 40. An unsaturated polyester is preferable because it has a high heat conductivity, is less likely to crack, and is not expensive. Alternatively, for example, an epoxy resin, a urethane resin, a PPS resin, a polybutylene terephthalate (PBT) resin, an acrylonitrile butadiene styrene (ABS) resin, and the like may be used as the material of the external resin portion 40. The resin material of the external resin portion 40 may be the same as or may be different from the resin material of the internal resin portion 30. The heat dissipation efficiency of the resin may be increased by adding a ceramic filler described above.

The reactor 1 described above can be preferably used as a reactor for an electric power converter of an electric vehicle, a hybrid vehicle, and the like. The energizing conditions of a reactor of this type are, for example, the maximum current (direct current) in the range of about 100 A to 1000 A, the average voltage in the range of about 100 V to 1000 V, and the used frequency in the range of about 5 kHz to 100 kHz.

<Method of Manufacturing the Reactor>

The reactor 1 described above is manufactured through the following steps (1) to (3), which are roughly divided:

(1) a first molding step of obtaining a coil molded product by molding the coil and the internal core portion provided with the cushioning member with an internal resin portion;

(2) an assembly step of assembling the coil molded product and the couple core portion to form an assembly; and (3) a second molding step of making a reactor by molding the assembly with the external resin portion.

(1) First Molding Step

First, a single wire is wound so as to form the coil 10, which includes the pair of coil elements 10A and 10B, which are coupled to each other through the couple portion 10*r*. Next, as illustrated in FIG. 3(A), the internal core portions 22 are prepared; heat shrinkable tubes to become the cushioning members 70 are fitted onto the outer peripheries of the internal core portions 22; and the tubes are heated and made to shrink so as to be attached to the outer peripheral surfaces of the internal core portions 22 (FIG. 3(B)). Next, the internal core portions 22 provided with the cushioning members 70 are inserted into the coil elements 10A and 10B (FIG. 4(A)). Subsequently, a mold, which is used to mold the internal resin portion 30 on the outer periphery of an assembly including the coil 10 and the internal core portions 22 provided with the cushioning members 70, is prepared.

This mold includes a pair of first and second molds that are openable and closable. The first mold includes an end plate that is positioned adjacent to one end of the coil 10 (near the leading and trailing ends of the wire). The second mold includes an end plate that is positioned adjacent to the other end of the coil (near the couple portion 10*r*) and sidewalls that cover the periphery of the coil 10.

The coil 10 and the internal core portions 22 provided with the cushioning members 70 are placed in the mold in an assembled state. At this time, corner portions of the coil elements 10A and 10B are supported by protrusions (not shown) on the inner surface of the mold, and a certain gap is formed between non-protruding portions of the inner surface of the mold and the coil 10. Moreover, end surfaces of the internal core portions 22 provided with the cushioning members 70 are supported by a recess in the mold, and a certain gap is formed between the cushioning members 70 and the coil elements 10A and 10B. This gap is filled with a resin to become the interposed resin portion 31*i*.

The first and second molds include a plurality of rod-like elements that can be inserted into and extracted from the mold using a drive mechanism. Here, eight rod-like elements are used to press substantially corner portions of the coil elements 10A and 10B, thereby compressing the coil 10. However, because it is difficult to press the couple portion 10*r* with the rod-like elements, a portion below the couple portion 10*r* is pressed by the rod-like elements. The thickness of each rod-like element is made as small as possible so that the number of portions of the coil 10 that are not covered by the internal resin portion may be reduced. However, the rod-like elements need to have a sufficient strength for compressing the coil 10 and a sufficiently high heat resistance. When the coil 10 is placed in the mold, the coil 10 has not been compressed and there are gaps between adjacent turns.

Next, the rod-like elements are inserted into the mold, thereby compressing the coil 10. Due to this compression, adjacent turns of the coil 10 come into contact with each other, and the gaps between adjacent turns are substantially eliminated. Moreover, the sensor storing pipe is disposed at a predetermined position of the coil 10 that is in a compressed state in the mold.

Subsequently, an epoxy resin is injected into the mold through a resin injection hole. When the injected resin has hardened to a certain extent and the coil 10 is retained in a compressed state, the rod-like elements may be extracted from the mold.

When the resin has hardened and the coil molded product 1M, in which the coil 10 in a compressed state and the internal core portions 22 provided with the cushioning members 70 are integrated with each other, is formed, the mold is opened and the coil molded product is taken out of the mold.

The obtained coil molded product 1M (FIG. 4(B)) has portions that have been pressed by the rod-like elements and that are not covered by the internal resin portion 30 and has a plurality of small holes. These small holes may be filled with an appropriate insulating material or may be left unfilled. In the case where the coil 10 is used in an uncompressed state with its free length, it is not necessary to compress the coil 10 by using the rod-like elements.

(2) Assembly Step

First, as illustrated in FIG. 5, the metal terminals 50 are welded to the ends 10*e* of the wire of the obtained coil molded product 1M. At the time of welding, as illustrated by dashed line in FIG. 6, the connection faces 52 of the metal terminals are substantially parallel to the weld faces 54 and extend in the up-down direction in the figure. After the external resin portion 40 has been formed, the connection faces 52 are bent by substantially 90° so as to cover the upper surface of the nut 60. In FIG. 5, the connection faces 52 of the metal terminals 50 have been bent.

Next, the end surfaces of both of the internal core portions 22 are disposed between the couple core portions 24, and the internal core portions 22 and the couple core portions 24 are joined to each other to form the annular core 20. The couple core portions 24 and the internal core portions 22 are joined to each other with an adhesive.

(3) Second Molding Step

Figure 7:
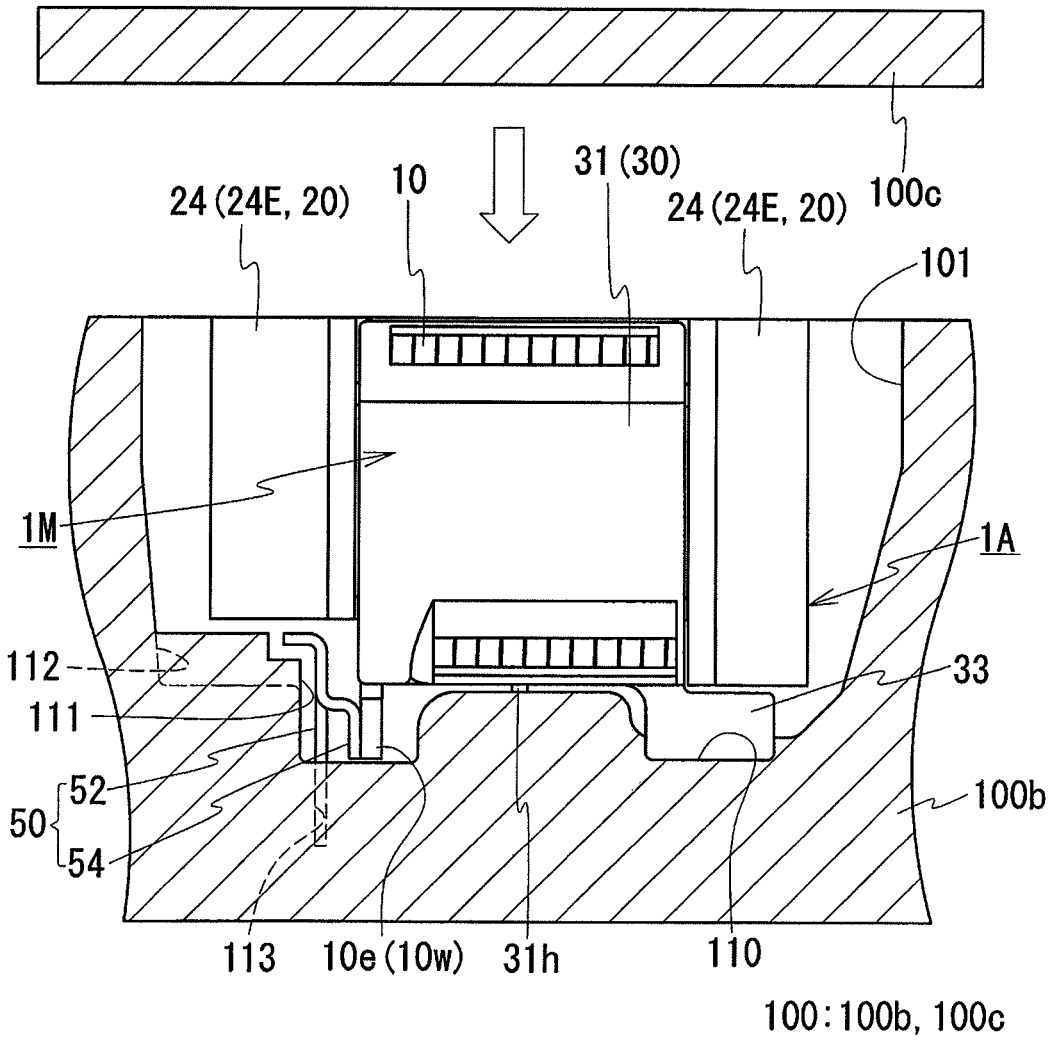
FIG. 7 is a schematic sectional view illustrating a state in which the assembly included in the reactor according to the first embodiment is placed in a mold.

Next, a mold for forming the external resin portion 40 in the outer periphery of the assembly obtained in the assembly step is prepared. Here, as illustrated in FIG. 7, the mold 100 includes a base portion 100*b* having an opening in an upper part thereof and a lid portion 100*c* for closing the opening in the base portion 100*b*. In a cavity 101 of the base portion 100*b*, the assembly 1A is placed in an inverted state, in which the upper surface in FIG. 2 faces downward.

The cavity 101 of the base portion 100*b* is shaped so as to form mainly the upper side of the outer shape of the external resin portion 40 illustrated in FIG. 1, i.e., the outer shape of the reactor 1. In particular, a fitting groove 110, into which the upper side of the couple portion covering portion 33 of the coil molded product 1M is fitted, is formed in the bottom surface of the cavity 101 of the base portion 100*b*. By fitting the couple portion covering portion 33 into the fitting groove 110, the assembly 1A can be easily positioned at a predetermined position in the cavity 101. That is, a part of the couple portion covering portion 33 functions as a positioning portion for positioning the assembly 1A with respect to the mold 100.

Three resin injection gates are formed along the same line in the bottom surface of the base portion. Among the three gates, an internal gate, which is positioned in the middle, is open at a position between the pair of coil elements 10A and 10B, which are parallelly arranged, when the assembly is disposed in the base portion. The remaining two remaining external gates, between which the internal gate is disposed, are each open at a position at which the couple core portion 24 is interposed between the external gate and the internal gate.

Moreover, recesses 111 to 113 and protrusions are formed in/on the bottom surface of the cavity 101 of the base portion 100*b*. The recesses 111 are used to form a protection portion that covers the joint positions at which the ends 10*e* of the wire 10*w* are joined to the metal terminals 50. The protrusions (not shown) are used to form the nut accommodating holes, into which the nuts 60 (FIG. 2) are fitted. The recess 112 is used to form the terminal base. The recesses 113 are used to insert the connection faces 52 of the metal terminals 50 thereinto in a state in which the connection faces 52 extend parallel to the weld faces 54. Portions of the cavity 101 for forming the side surfaces of the external resin portion 40 are inclined surfaces that widen toward the opening.

The lid portion 100*c*, which has a flat surface that faces the base portion 100*b*, is capable of forming the mount surface of the reactor 1 into a flat surface. Because the surface of the lid portion 100*c* facing the base portion 100*b* is a flat surface, the lid portion 100*c* does not have protrusions and recesses, in which air tends to be retained when injecting a resin into the mold 100 that is sealed by the lid portion 100*c*. Therefore, defects are not likely formed in the external resin portion 40. Instead of forming the resin injection gates in the base portion 100*b*, resin injection gates may be formed in the lid portion 100*c*. In this case, resin injection gates may be formed at positions in the lid portion 100*c* facing the resin injection gates of the base portion 100*b*. If the mount surface of the reactor 1 is a flat surface having no protrusions and recesses, resin may be injected into the base portion 100*b* without using the lid portion 100*c*. In this case, the liquid surface of the injected resin forms the mount surface of the reactor 1.

The assembly 1A is disposed in the mold 100. To be specific, a part of the couple portion covering portion 33 of the coil molded product 1M of the assembly 1A is fitted into the fitting groove 110. With this step, the assembly 1A is positioned with respect to the mold 100. Due to the fitting, an end surface of the cylindrical body that forms the sensor-use hole 31*h* comes into contact with the bottom surface of the cavity 101 of the base portion 100*b*. Due to the cylindrical body and due to the fitting, the assembly 1A is maintained in a state in which the assembly 1A is supported on the bottom surface of the cavity 101 and disposed at a predetermined position in the cavity 101. Moreover, joint portions at which the ends 10*e* of the wire 10*w* are joined to the metal terminals 50 are inserted into the recesses 111, and the connection faces 52 of the metal terminals 50 are inserted into the recesses 113.

When the assembly 1A is disposed as described above, the mold 100 is closed by placing the lid portion 100*c* so as to cover the opening of the base portion 100*b*, and the resin material of the external resin portion 40 (here, an unsaturated polyester) is injected into the mold 100 through the resin injection gates. At this time, because the resin is injected from the inside and the outside of the annular core 20, a pressure applied to the core 20 from the inside toward the outside of the core 20 and a pressure applied to the core 20 from the outside toward the inside of the core 20 cancel each other out, and thereby filling with the resin can be performed in a short time without damaging the core 20. This is particularly effective when the injection pressure of the resin is high.

When the external resin portion 40 has been formed, the mold 100 is opened and the reactor 1 is taken out of the mold 100. At this time, the reactor 1 can be removed easily because the opening side of the cavity 101 has inclined surfaces. The nuts 60 (FIG. 2) are fitted into the nut accommodating holes in the reactor 1 that has been taken out, the connection faces 52 of the metal terminals 50 are bent at substantially 90° as illustrated in FIGS. 2, 5, and 6 so as to cover the upper surfaces of the nuts 60 by the connection faces 52, and thereby making of the reactor 1 is finished.

As described above, the reactor according to the present invention has the following advantages.

Because the outer periphery of the internal core portion 22 is covered by the cushioning member 70, a stress generated by contraction of the interposed resin portion 31*i*, which is interposed between the coil 10 and the cushioning member 70, is reduced even when the reactor 1 is subjected to a thermal cycle, and thereby cracking of the interposed resin portion 31*i* is prevented.

Because the internal resin portion 30 retains the coil 10 so that the coil 10 cannot extend and contract, difficulty in handling a coil due to extension and contraction of the coil is reduced. Therefore, the reactor 1 has a high productivity.

Because the internal resin portion 30 and the cushioning members 70 function as insulation between the coil 10 and the core 20, a sleeve-like bobbin or a frame-like bobbin, which is used in existing reactors, are not necessary.

Because the sensor-use hole 41*h* is formed when the internal resin portion 30 and the external resin portion 40 are molded, postprocessing for forming the sensor-use hole 41*h* is not necessary. Therefore, the reactor 1 can be efficiently manufactured, and damage to the coil 10 and the core 20, which may occur when postprocessing the sensor-use hole, can be avoided.

Because the reactor includes two layers of resin portions, i.e., the internal resin portion 30 and the external resin portion 40, the reactor 1 provided with mechanical and electrical protection can be easily formed without using a metal case. In particular, when the internal resin portion 30 is made from a resin having a high heat dissipation efficiency and the external resin portion 40 is made from a resin having a high shock resistance, the reactor has a high heat dissipation efficiency and mechanical strength. In particular, due to the presence of the external resin portion 40, the reactor 1 has a high mechanical strength even if the core is formed from a powder molded product composed of soft magnetic powder.

Because through holes 42*h* for fixing the reactor 1 to a cooling base are formed in the flange portion 42 of the external resin portion 40, the reactor 1 can be mounted on a cooling base only by screwing bolts through the through holes 42*h* into the cooling base. It is not necessary to prepare fasteners for pressing the reactor other than bolts. In particular, the through holes 42*h* are reinforced because metal collars 42*c* are disposed in the through holes, and thereby cracking of the flange portion 42 due to fastening the bolts can be prevented.

The height of the reactor 1 including the metal terminals 50 is not large, because the heights of the pair of couple core portions 24 are different, the metal terminals 50 are disposed on one of the couple core portions 24 having a smaller height, and the couple core portion 24 and the coil molded product 1M are integrally molded with the external resin portion 40.

Because the metal terminals 50 are integrally molded with the external resin portion 40, the terminal base can be formed simultaneously with molding the external resin portion 40. Therefore, members and operations for fixing an independently formed terminal base to the reactor 1 can be omitted.

Because the couple portion 10*r* is disposed above the turn-formed faces 10*f*, the thickness (length in the coil axis direction) of the couple core portion 24 can be reduced while increasing the height of the couple core portion 24, and thereby the projected area of the reactor 1 can be reduced. In particular, because the core 20 is made from a powder molded product composed of soft magnetic powder, the core 20, in which the height of the couple core portion 24 is different from that of the internal core portion 22, can be easily molded. Because the lower surface of the couple core portion 24 is flush with the lower surface of the coil molded product 1M and the lower surface of the external resin portion 40, the reactor 1 has a flat mount surface and has a large area of contact with a mount object, and thereby heat can be efficiently dissipated.

Because the nut accommodating holes 43, instead of the nuts 60, are molded from the external resin portion 40, the nuts 60 are not present when molding the external resin portion 40, and thereby a fault in that the resin material of the external resin portion 40 enters into the nuts can be prevented. Because the connection faces 52 of the metal terminals 50 are bent so as to cover the opening of the nut accommodating holes by the connection faces 52 after the nuts 60 have been accommodated in the nut accommodating holes 43, coming off of the nuts 60 can be easily prevented.

Because a positioning portion that is integrally formed with the internal resin portion 30 of the coil molded product 1M is provided, the assembly 1A can be easily positioned with respect to the mold 100 without using an additional pin or bolt when forming the external resin portion 40. Also in this respect, the reactor 1 has a high productivity.

Because positioning is performed without using a pin or the like that is additionally prepared, portions of the assembly 1A that are not covered by the external resin portion 40 can be effectively reduced. Moreover, although the positioning portion is exposed from the external resin portion 40, the internal resin portion 30 is present in the positioning portion. Therefore, the reactor 1 can sufficiently protect the coil 10 and the core 20 both mechanically and from the external environment due to the presence of the internal resin portion 30 and the external resin portion 40.

(Modification 1-1)

Figure 8:
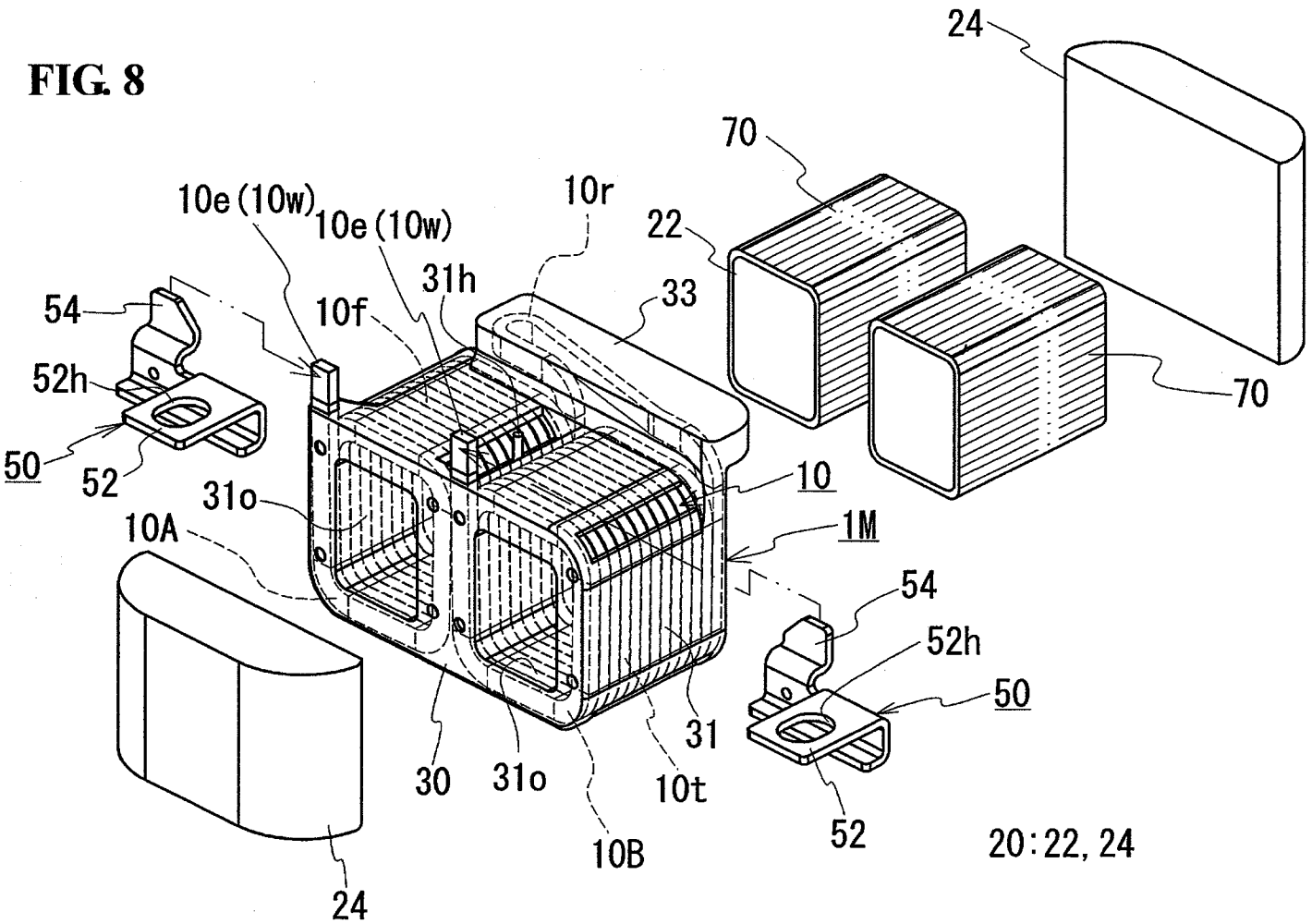
FIG. 8 is an exploded perspective view of an assembly included in a reactor according to a modification 1-1.

In the first embodiment, the coil molded product 1M includes the coil 10 and the internal core portions 22 provided with the cushioning members 70, which are integrated with each other using the internal resin portion 30. However, as illustrated in FIG. 8, the internal resin portion 30 may be molded so as to form hollow bores 31*o* inside of the coil elements 10A and 10B. This molding may be performed by inserting a core, instead of inserting the internal core portions 22 provided with the cushioning members 70, into the coil 10, and by injecting the resin material of the internal resin portion in a state in which the coil having the core inserted therein is disposed in the mold. Then, the internal core portions 22 provided with the cushioning members 70 are inserted into the hollow bores 31*o* formed from the internal resin portion 30. Subsequently, the couple core portion 24 is joined to the internal core portion 22, the external resin portion is molded in the same way as the first embodiment, thereby forming a reactor.

Second Embodiment

Figure 9:
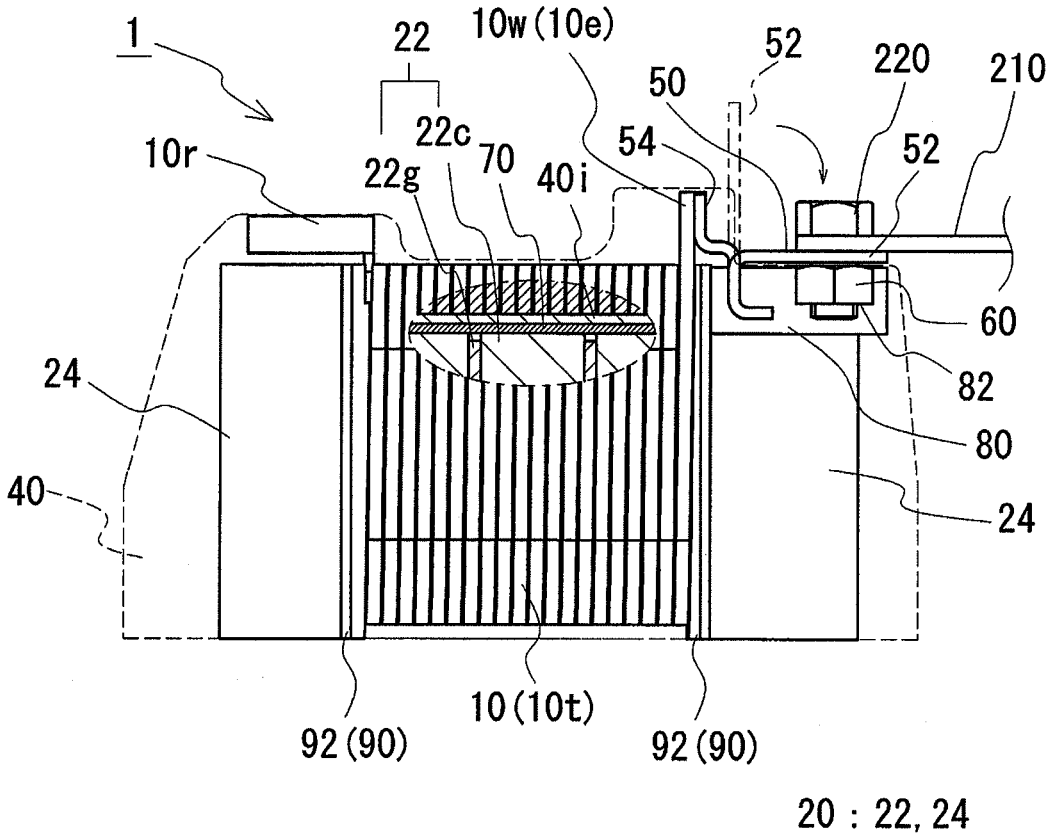
FIG. 9 is a partial sectional view of a reactor according to a second embodiment.

Next, referring to FIG. 9, a reactor according to the present invention that does not include the internal resin portion, which is used in the reactor according to the first embodiment, and that only includes the external resin portion will be described.

The present embodiment differs from the first embodiment mainly in that the second embodiment does not include the internal resin portion, and the description below will be focused on this difference because the configurations of the present embodiment and the first embodiment are substantially the same in other respects.

In the present embodiment, a pre-molded product 80, in which the metal terminals 50 have been insert-molded, is produced beforehand. The pre-molded product 80 is a block-like molded product that is formed so as to cover embedded portions of the metal terminals 50 and that can be placed on the upper surface of one of the couple core portion 24 having a smaller height. Nut accommodating holes 82 for accommodating the nuts 60 are formed in the pre-molded product 80. As the resin material of the pre-molded product 80, a resin material the same as that of the internal resin portion and the external resin portion in the first embodiment can be used. As in the first embodiment, the cushioning members 70 are attached to the outer peripheries of the internal core portions 22, and the connection faces 52 of the metal terminals are bent so as to face the nuts 60.

When assembling the reactor 1 according to the present embodiment, a bobbin 90 that insulates between the coil 10 and the core 20 is used. As the bobbin 90, a frame-like bobbin 92, which is interposed between the ends of the coil 10 and the couple core portion 24, is used. In the present embodiment, the cushioning members 70 function as sleeve-like bobbins that cover the outer peripheries of the internal core portions 22, and therefore sleeve-like bobbins used in existing reactors are not necessary.

To make the reactor 1, the pre-molded product 80 is attached to an assembly including the coil 10, the core 20, and the bobbin 90. To be specific, weld faces 54 protruding from the pre-molded product 80 are welded to the ends 10*e* of the wire of the coil. Then, the external resin portion 40 is molded on the outer periphery of the assembly. At this time, the resin material of the external resin portion 40 enters through spaces between turns of the coil 10 and into spaces between the coil 10 and the cushioning members 70, and the resin material hardens to form an interposed resin portion 40*i*.

Also in the present embodiment, if the reactor 1 is subjected to a thermal cycle, the interposed resin portion 40*i* contracts when the temperature decreases. However, cracking of the interposed resin portion 40*i* is prevented because the cushioning members 70 function as a cushion.

Third Embodiment

Next, referring to FIGS. 10 to 11, a reactor 1α according to a third embodiment, which is an irregular-pot-shaped reactor, will be described. The reactor 1α is an irregular-pot-shaped reactor including a coil 10, which has a coil element made by winding a wire 10*w*, and a core 20 in which the coil 10 is disposed. The core 20 includes an internal, core portion 22, which is inserted through the coil 10, and a couple core portion 24, which is disposed in the outer periphery of the coil 10 and coupled to the internal core portion 22. These core portions 22 and 24 form a closed magnetic path. The outer periphery of the internal core portion 22 is covered by a cushioning member 70. Almost the entire surface of the inside and the outside of the coil 10 is covered by an internal resin portion 30 (FIG. 10(B)). The internal resin portion 30 integrates the coil 10 with the internal core portion 22, thereby forming a coil molded product. The coil molded product is contained in a case 120. The couple core portion 24 is made of a mixture of magnetic powder and a resin. Almost the entire periphery of the coil 10 (coil molded product) is covered by the couple core portion 24, and the coil 10 is sealed in the case 120. These components will be described below in detail.

[Coil]

The coil 10 is a cylindrical member that is made by helically winding a single continuous wire. The wire 10*w* is the same as that of the first embodiment. Here, an insulated rectangular wire, which includes a conductor that is a rectangular copper wire and an insulation coating made of an enamel (typically, polyamidoimide), is used. It is preferable that the thickness of the insulation coating be in the range of 20 μm to 100 μm. The larger the thickness, the smaller the number of pin holes and the higher the insulation ability. The coil 10 is made by winding the insulated rectangular wire edgewise. Because the shape of the coil is cylindrical, an edgewise-wound coil can be made relatively easily.

Figure 10:
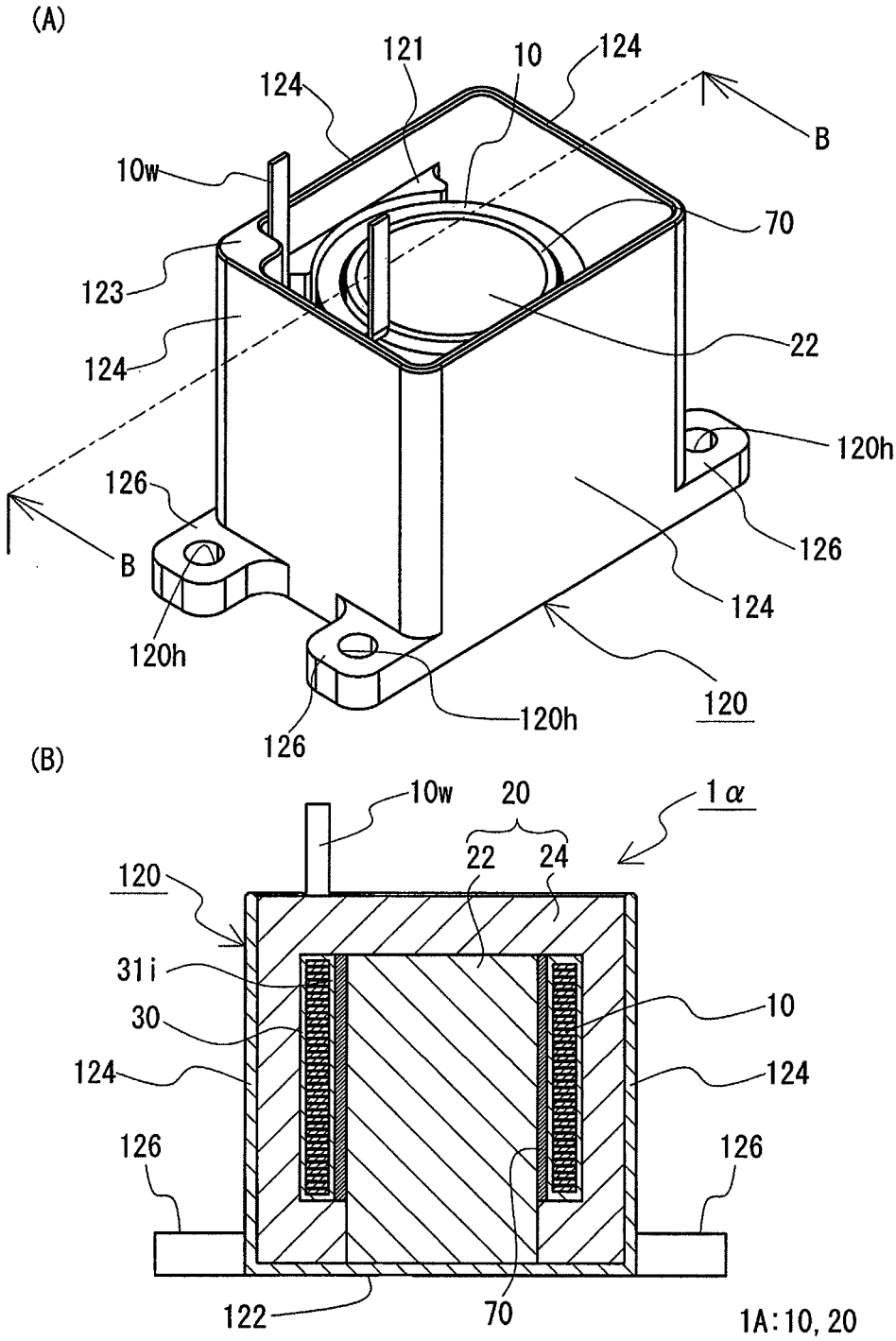
FIG. 10 illustrates a reactor according to a third embodiment, FIG. 10(A) illustrating a schematic perspective view, and FIG. 10(B) illustrating a sectional view taken along line B-B of FIG. 10(A).
Figure 11:
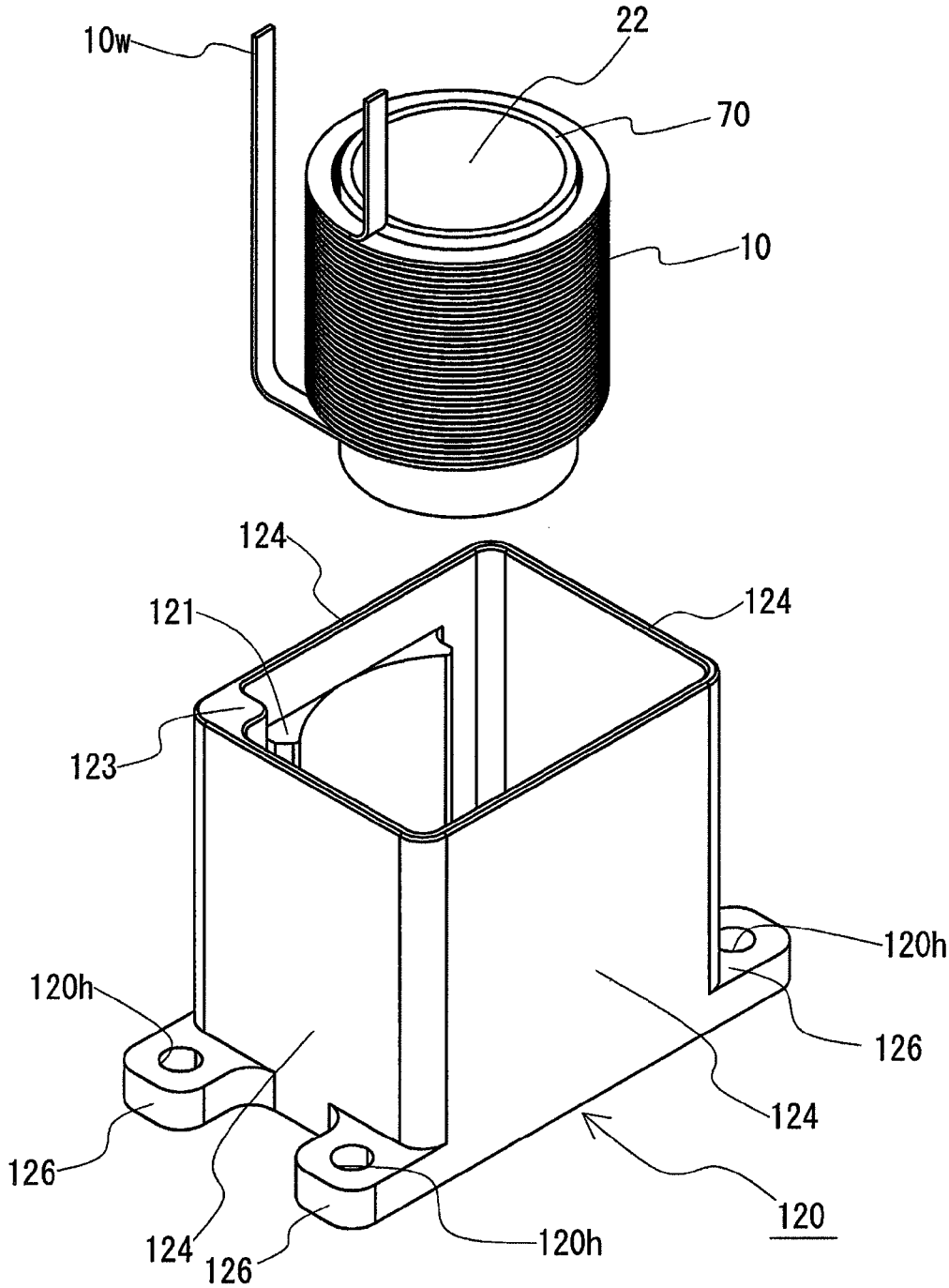
FIG. 11 illustrates steps of assembling the reactor according to the third embodiment.

As illustrated in FIGS. 10 and 11, ends of the wire 10*w* of the coil 10 are appropriately drawn out from the turn portion to the outside through the couple core portion 24 described below. Terminal members (not shown), which are made of a conducting material such as copper or aluminium, are connected to the conductor portions of the wire 10*w*, which have been exposed by stripping off the insulation coating. An external apparatus (not shown) for supplying electric power to the coil 10, such as an electric power supply, is connected to the coil 10 through the terminal members. The conductor portions of the wire 10*w* and the terminal members are connected to each other by welding such as TIG welding or by crimping. Here, the ends of the wire 10*w* are drawn out in a direction parallel to the axial direction of the coil 10. However, the ends may be drawn out in any appropriate direction.

In the reactor 1α, the coil 10 is disposed in the case 120 in such a way that the axial direction of the coil 10 is oriented perpendicular to a bottom surface 122 of the case 120 when the reactor 1α is mounted on a mount object (hereinafter, this disposition will be referred to as the vertical configuration).

[Core]

The core 20 is a so-called irregular-pot-shaped core, which includes a cylindrical rod-like core member (internal core portion 22) that is insert through the coil 10 and an external core member (couple core portion 24) that covers almost the entire outer periphery of the assembly including the coil 10 and the internal core portion 22. The couple core portion 24 is a magnetic piece that covers substantially both sides (the sides that are cut along line B-B of FIG. 10(A)) and the upper surface of the coil 10 and that has a substantially C-shaped cross section. The front and back sides (the sides that face guide protrusions 121) of the coil 10 are covered by only a very thin parts of the couple core portion. In particular, one of the characteristics of the reactor 1α is that the internal core portion 22 and the couple core portion 24 are made of different materials and the core portions 22 and 24 have different magnetic characteristics. To be specific, the internal core portion 22 has a saturation flux density higher than that of the couple core portion 24 and the couple core portion 24 has a magnetic permeability lower than that of the internal core portion 22.

<<Internal Core Portion>>

The internal core portion 22 has a cylindrical outer shape that follows the shape of the inner peripheral surface of the coil 10, and the entirety of the internal core portion 22 is formed of a powder molded product. Here, the internal core portion 22 is a solid body in which gap members and air gaps are not present. However, gap members and air gaps may be present if appropriate. Alternatively, for example, the internal core portion 22 may include a plurality of segments that are integrally joined to one another by using an adhesive.

Typically, a powder molded product is obtained by molding soft magnetic powder that is coated with an insulator or mixture powder including the soft magnetic powder and an appropriate amount of binder, and then baking the molded product at a temperature that is equal to or lower than the maximum allowable temperature of the insulation coating. A powder molded product having a three-dimensional shape can be easily formed. For example, an internal core portion having a shape that fits with the shape of an inner peripheral surface of a coil can be easily formed. Because a powder molded product includes insulators between magnetic particles, the magnetic particles are insulated from one another, and therefore eddy-current loss can be reduced. In particular, the loss can be reduced even if high-frequency electric power is supplied to the coil.

The soft magnetic powder may be powder of iron group metal such as Fe, Co, or Ni; powder of an iron-based alloy such as Fe—Si, Fe—Ni, Fe—Al, Fe—Co, Fe—Cr, Fe—Si—Al, or the like; or powder of a rare-earth metal; or ferrite powder. In particular, a powder molded product having a high saturation flux density can be made more easily from powder of an iron-based alloy than from powder of a magnetic material such as ferrite. The insulation coating formed on the soft magnetic powder may be made of, for example, a phosphate compound, a silicon compound, a zirconium compound, an aluminium compound, or a boron compound. The binder is, for example, a thermoplastic resin, a non-thermoplastic resin, or a higher fatty acid. The binder may be eliminated or changed into an insulator such as silica in the baking step. As the powder molded product, a powder molded product of a known type may be used.

The saturation flux density of a powder molded product can be changed by adjusting the material of the soft magnetic powder, the mixing ratio of the soft magnetic powder to the binder, or the amounts of various coatings. For example, a powder molded product having a high saturation flux density can be obtained by using soft magnetic powder having a high saturation flux density or by increasing the ratio the soft magnetic material to the binder. Moreover, the saturation flux density can be increased by changing, or more specifically, increasing the molding pressure. The material of the soft magnetic powder and the molding pressure may be adjusted so that the saturation flux density becomes a desired value.

Here, the internal core portion 22 is a powder molded product that is made from soft magnetic powder having insulation coating.

The length of the internal core portion 22 in the axial direction of the coil 10 (hereinafter, referred to only as the length) may be appropriately selected. In the example illustrated in FIGS. 10 and 11, the length of the internal core portion 22 is slightly larger than that of the coil 10, and both ends surfaces of the internal core portion 22 and the vicinities thereof protrude from the end surfaces of the coil 10. However, the length of the internal core portion 22 may be the same as that of the coil 10 or may be slightly smaller than that of the coil 10. If the length of the internal core portion 22 is equal to or larger than that of the coil 10, magnetic flux that is generated by the coil 10 can sufficiently pass through the internal core portion 22. Moreover, the protruding length of the internal core portion 22 from the coil 10 can be appropriately selected. In the example illustrated in FIGS. 10 and 11, the protruding length with which the internal core portion 22 protrudes from one end surface of the coil 10 is larger than that from the other end surface of the coil 10. However, the protruding lengths with which the internal core portion 22 protrudes from both end surfaces of the coil 10 may be the same. In particular, in the vertical configuration described above, as in the example illustrated in FIG. 10(B), the internal core portion 22 can be stably disposed in the case 120 by disposing the internal core portion 22 in the case 120 in such a way that one end surface of the internal core portion 22 protruding from one end surface of the coil 10 comes into contact with the bottom surface 122 of the case 120. As a result, the couple core portion 24 can be easily formed.

<<Couple Core Portion>>

The couple core portion 24 is an external core member that forms a closed magnetic path jointly with the internal core portion 22 as described above. Moreover, the couple core portion 24 functions as a sealing member that covers the outer periphery of the assembly including the coil 10 and the internal core portion 22 and that seals both of these in the case 120. Therefore, the reactor 1α includes a hardened molded product that extends from the bottom surface 122 to the opening of the case 120 and that is made of a mixture of magnetic powder and a resin, and the hardened molded product is the couple core portion 24. The couple core portion 24 and the internal core portion 22 are joined to each other without using an adhesive but using the resin material of the couple core portion 24. Therefore, the core 20 is an integrated body, the entirety of which is integrated without using an adhesive or a gap member.

Typically, the hardened molded product can made by injection molding or by cast molding. In the case of injection molding, magnetic powder of a magnetic material and a fluid resin are mixed with each other, the mixture is injected into a mold and molded by applying a predetermined pressure, and then the resin is hardened. In the case of cast molding, after obtaining a mixture the same as that of injection molding, the mixture is injected into a mold and molded without applying a pressure, and then the mixture is hardened.

In either of the molding methods, soft magnetic powder that is the same as that used for the internal core portion 22 may be used as magnetic powder. In particular, as soft magnetic powder used for the couple core portion 24, powder of an iron-based material such as powder of pure iron or powder of an iron-based alloy may be preferably used. Because an iron-based material has a saturation flux density and a magnetic permeability that are higher than those of a ferrite or the like, a core having certain levels of saturation flux density and magnetic permeability can be obtained even if the proportion of the resin is high. Coated powder that is composed of particles that are made of a soft magnetic material and that are coated with a coating made of a phosphate may be used. Such magnetic powder can be easily used when the average diameter of particles is in the range of 1 μm to 1000 μm, or more preferably, in the range of 10 μm to 500 μm.

In either of the molding methods, a thermosetting resin such as an epoxy resin, a phenolic resin, or a silicone resin can be preferably used as a binder resin. If a thermosetting resin is used, the resin is hardened by heating the molded product. A room-temperature setting resin or a cold setting resin may be used. In this case, the resin is hardened by letting the molded product stand at a room temperature or at a comparatively low temperature. The proportion of a non-magnetic resin in the hardened molded product is higher than that of a powder molded product or a magnetic steel plate described below. Therefore, the saturation flux density is low and the magnetic permeability is low even if soft magnetic powder that is the same as that used for the powder molded product of the internal core portion 22 is used for the couple core portion 24.

The magnetic permeability and the saturation flux density of a hardened molded product can be adjusted by changing the mixture ratio of the magnetic powder to the binder resin. For example, when the proportion of the magnetic powder is reduced, a hardened molded product having a low magnetic permeability can be obtained.

Here, the couple core portion 24 is a hardened molded product made from a mixture of coated powder and an epoxy resin. The coated powder includes particles that are made of an iron-based material, that have an average diameter equal to or smaller than 100 μm, and that have insulation coating.

In this example, the couple core portion 24 covers almost the entire periphery the coil molded product including the coil 10, the internal core portion 22, and the internal resin portion 30. However, a part of the coil 10 need not be covered by the core 20 (but needs to be covered by the case 120).

<<Magnetic Characteristics>>

It is preferable that the saturation flux density of the internal core portion 22 be 1.6 T or higher, more preferably 1.8 T or higher, and further preferably 2 T or higher. It is preferable that the saturation flux density of the internal core portion 22 be 1.2 times that of the couple core portion 24 or higher, more preferably 1.5 times that or higher, and further preferably 1.8 times that or higher. When the internal core portion 22 has a saturation flux density that is sufficiently higher than that of the couple core portion 24, the cross sectional area of the internal core portion 22 can be reduced. It is preferable that the relative magnetic permeability of the internal core portion 22 be in the range of 50 to 1000, and more preferably in the range of about 100 to 500.

It is preferable that the saturation flux density of the couple core portion 24 be equal to or higher than 0.5 T and lower than that of the internal core portion. It is preferable that the relative magnetic permeability of the couple core portion 24 be in the range of 5 to 50, and more preferably in the range of about 5 to 30. If the relative magnetic permeability of the couple core portion 24 is in the range described above, the average magnetic permeability of the entirety of the core 20 is prevented from becoming too high, and for example, the core 20 may have a gapless structure.

Here, the saturation flux density of the internal core portion 22 is 1.8 T, and the relative magnetic permeability is 250. The saturation flux density of the couple core portion 24 is 1 T, and the relative magnetic permeability is 10. The materials of the internal core portion 22 and the couple core portion 24 may be adjusted so that the saturation flux densities and the magnetic permeabilities of these portions may have desired values.

[Cushioning Member]

The cushioning member 70 is disposed so as to cover the entire periphery of a portion of the outer peripheral surface of the internal core portion 22 corresponding to the inner periphery of the coil 10. As in the first embodiment, the cushioning member 70 has a function of preventing cracking of the interposed resin portion 31*i* (FIG. 10(B)) described below due to a thermal cycle while the reactor 1α is being used and a function of increasing the insulation between the coil 10 and the internal core portion 22. A cushioning member the same as that of the first embodiment can be used as the cushioning member 70. In the present embodiment, a heat shrinkable tube "Sumitube K" or "Sumitube B2" made by Sumitomo Electric Fine Polymer Cooperation is used as the cushioning member 70.

[Internal Resin Portion]

As in the first embodiment, the internal resin portion 30 covers the inner and outer peripheries of the coil 10, and integrates the internal core portion 22 provided with the cushioning member 70 with the coil 10. The material of the internal resin portion is the same as that in the first embodiment. As illustrated in FIG. 10(B), a part of the internal resin portion 30 is disposed between the inner periphery of the coil 10 and the outer periphery of the cushioning member 70 and forms the interposed resin portion 31*i*. The internal resin portion 30 also contributes to increasing the insulation between the coil 10 and the internal core portion 22. In the present embodiment, the internal resin portion 30 integrates the coil 10 and the internal core portion 22 provided with the cushioning members with each other. Alternatively, as in modification 1-1, only the coil 10 may be molded with the internal resin portion 30 so as to form a hollow bore in the inner periphery of the coil, and the internal core portion 22 provided with the cushioning members may be inserted into the hollow bore.

[Case]

The case 120, which contains the assembly 1A including the coil 10 and the core 20, is a rectangular box including the bottom surface 122 that is located adjacent to a mount object (not shown) when the reactor 1α is mounted on the mount object, sidewalls 124 standing from the bottom surface 122, and an opening that faces the bottom surface 122.

The shape and size of the case 120 may be appropriately selected. For example, the case 120 may have a cylindrical shape that follows the shape of the assembly 1A. As the material of the case 120, a conductive non-magnetic material such as aluminium, an aluminium alloy, magnesium, or a magnesium alloy can be preferably used. A case made of a conductive non-magnetic material can effectively prevent leakage of magnetic flux to the outside of the case. A case made of a light metal such as aluminium, magnesium, or an alloy thereof has a strength higher than that made of a resin and a weight smaller than that made of a resin. Therefore, such a case is preferable for a vehicle component for which reduction in weight is required. Here, the case 120 is made of aluminium.

Moreover, the case 120 illustrated in FIGS. 10 and 11 includes the guide protrusions 121, a positioning portion 123, and a coil supporting portion (not shown). The guide protrusions 121, which protrude from the inner peripheral surfaces of the sidewalls 124, prevent the coil 10 from being rotated and function as guides when inserting the coil 10. The positioning portion 123, which protrudes from a corner of the inner peripheral surface the case 120, is used to position an end of the wire 10*w*. The coil supporting portion, which is disposed on the inner peripheral surface of the case 120 and protrudes from the bottom surface 122, supports the coil 10 and determines the height of the coil 10 with respect to the case 120. By using the case 120 including the guide protrusions 121, the positioning portion 123, and the coil supporting portion, the coil 10 can be disposed precisely at a desired position in the case 120, and the position of the internal core portion 22 with respect to the coil 10 can be precisely determined. The guide protrusions 121 and the like may be omitted. Other members may be prepared, and these members may be disposed in the case and may be used to position the coil 10. In particular, if the other members are hardened molded products made of a material the same as that of the couple core portion 24, the other members can be easily integrated when forming the couple core portion 24 and the other members can be used as a magnetic path. The case 120 illustrated in FIG. 10(A) includes attachment portions 126 that have bolt holes 120*h* that are used to fix the reactor 1α to a mount object (not shown) by using bolts. Because the case 120 has the attachment portions 126, the reactor 1α can be easily fixed to a mount object by using bolts.

[Other Components]

In order to increase the insulation between the coil 10 and the core 20, it is preferable that an insulator be disposed between the core 20 and a part of the coil 10 that contacts the core 20. In particular, it is preferable that insulation tape made of insulation paper or a resin be wound around or an insulation tube be fitted onto the outer periphery of a portion of the wire 10*w* that is disposed between the turn-forming portion of the coil 10 and an end of the coil 10 and that extends through the couple core portion 24.

[Size of Reactor]

When the volume of the reactor 1α including the case 120 is in the range of about 0.2 liter (200 $cm^3$) to 0.8 liter (800 $cm^3$), the reactor 1α can be preferably used as a vehicle part. The volume of the reactor 1α according to the present embodiment is 280 $cm^3$.

[Applications]

The reactor 1α can be preferably used in applications under electrical conditions such as the maximum current (direct current) in the range of about 100 A to 1000 A, the average voltage in the range of about 100 V to 1000 V, and the used frequency in the range of about 5 kHz to 100 kHz, which are typically as a component of a vehicle-mounted converter of an electric vehicle or a hybrid vehicle. For this application, the reactor 1α can be preferably used by adjusting the inductance when the direct current is 0 A to a value in the range of 10 μH to 2 μH, and more preferably 1 mH or lower; and by adjusting the inductance at the maximum current to be equal to or higher than 10% and more preferably equal to or higher than 30% of the inductance when the current is 0 A.

[Method of Manufacturing Reactor]

The reactor 1α can be manufactured, for example, as follows. First, the coil 10, the internal core portion 22 that is a powder molded product, and the cushioning member 70 are prepared. As illustrated in FIG. 11, an assembly including the coil 10, the internal core portion 22, and the cushioning member 70 is made by attaching the cushioning member 70 to the outer periphery of the internal core portion 22, and then inserting the internal core portion provided with the cushioning member into the coil 10.

Next, as in the first embodiment, a coil molded product is made by integrally molding the assembly with the internal resin portion 30. At this time, a part of the internal resin portion 30 enters a space between the inner periphery of the coil 10 and the outer periphery of the cushioning member 70, and thereby the interposed resin portion 31*i* is formed.

Next, the coil molded product is contained in the case 120. The coil molded product can be precisely disposed at a predetermined position by using the above-described guide protrusions 121 and the like. A mixture of magnetic powder and a resin for forming the couple core portion 24 (FIG. 10(B)) is made, and the case 120 is filled with the mixture. By making the mixture of the magnetic powder and the resin (before the resin is hardened) so as to have a magnetic powder content in the range of about 20 volume % to 60 volume % (resin content in the range of about 40 volume % to 80 volume %), the couple core portion 24 having a relative magnetic permeability in the range of 5 to 50 as described above can be formed. Here, the magnetic powder content is 40 volume % and the resin content is 60 volume %.

After filling the case 120 with the mixture of magnetic powder and a resin, the resin is hardened. When the resin hardens, the reactor 1α is obtained. Here, the resin is hardened in a stationary state for several minutes to several tens of minutes while maintaining the temperature at about 80° C. This temperature can be appropriately selected depending on the resin used. Alternatively, the resin may be hardened immediately after the case 120 is filled with the resin.

[Advantages]

Because the reactor 1α includes the interposed resin portion 31*i* and the cushioning member 70, which are disposed inside the coil in this order, even when the reactor 1α is subjected to a thermal cycle, a stress generated due to contraction of the interposed resin portion 31*i* disposed between the coil 10 and the cushioning member 70 is reduced, and therefore cracking of the interposed resin portion 31*i* is prevented.

Because the core 20 has an adhesiveless structure that is manufactured without using an adhesive at all, the reactor 1α has a high productivity. Moreover, because the internal core portion 22 of the reactor 1α is a powder molded product, the saturation flux density can be adjusted easily, a complex three-dimensional shape can be easily formed, and the reactor 1α has a high productivity also in this respect.

In addition, because the reactor 1α includes a single coil 10, the reactor 1α has a small size. In particular, in the reactor 1α, the saturation flux density of the internal core portion 22 is higher than that of the couple core portion 24. Therefore, as compared with the case where a core is made of a single material and the saturation flux density of the entire core is uniform, the same amount of magnetic flux can be obtained by the internal core portion 22 having a smaller cross sectional area (surface that the magnetic flux passes). The reactor 1α has a small size because the reactor 1α includes the internal core portion 22 having such configuration. Moreover, the saturation flux density of the internal core portion 22 is high, and the magnetic permeability of the couple core portion 24 is low. Therefore, the reactor 1α may have a gapless structure that does not have a gap member, and in this case, the reactor 1α has a size smaller than that of a reactor having a gap. Due to the gapless structure, the coil 10 and the internal core portion 22 can be disposed close to each other, and the reactor 1α has a small size also for this reason. In addition, the outer shape of the internal core portion 22 is a cylindrical shape that follows the cylindrical inner peripheral surface of the coil 10. Therefore, the coil 10 and the internal core portion 22 can be disposed closer to each other, and thereby the size of the reactor 1α can reduced.

Because the reactor 1α includes the case 120, the assembly 1A including the coil 10 and the core 20 can be protected from the external environment such as dust and corrosion and mechanically protected. Moreover, because the magnetic characteristics of the reactor 1α can be easily changed by adjusting the ratio of magnetic powder and resin forming the couple core portion 24, the inductance of the reactor 1α can be easily adjusted.

(Modification 3-1)

Figure 12:
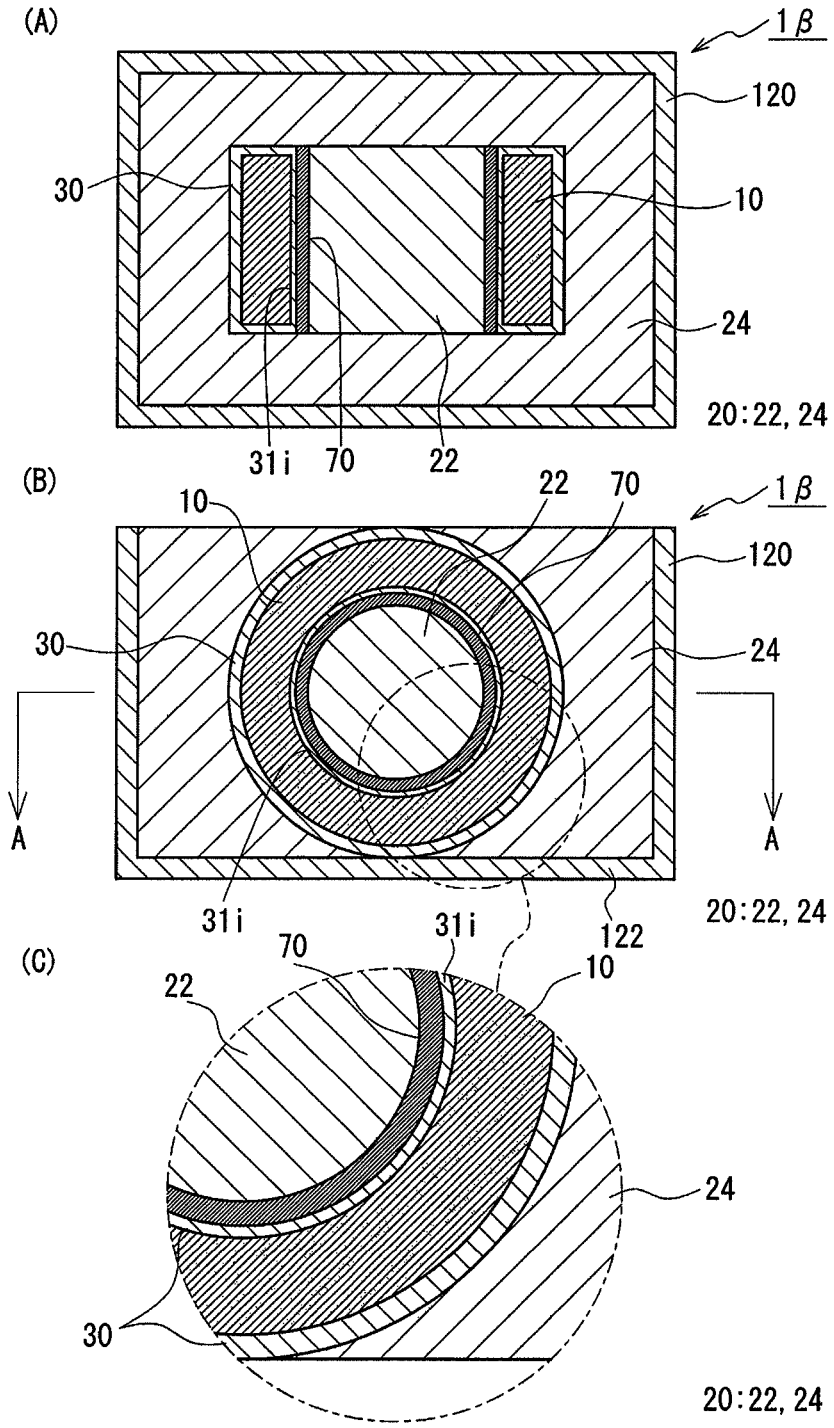
FIG. 12 illustrates a reactor according to a modification 3-1, FIG. 12(A) illustrating a sectional view taken along a horizontal plane extending along the axial direction of a coil, FIG. 12(B) illustrating a longitudinal sectional view taken along a vertical plane perpendicular to the axial direction of the coil, and FIG. 12(C) illustrating a partial enlarged view of FIG. 12(B).

In the third embodiment, the coil 10 is in the vertical configuration. Alternatively, as in a reactor 1β illustrated in FIG. 12, the coil 10 and the internal core portion 22 may be contained in the case 120 in such a way that the axial direction of the coil 10 is parallel to the bottom surface 122 of the case 120 (hereinafter, this configuration will be referred to as the horizontal configuration).

Also in the horizontal configuration, the cushioning member 70 the same as that of the first embodiment is disposed on the outer periphery of the internal core portion 22. As in the third embodiment, the material of the internal core portion 22 and the material of the couple core portion 24 are a powder molded product and a hardened molded product, respectively. With the same method as in the third embodiment, the reactor 1β can be obtained by using the coil 10 and the case 120 that are the same as those of the third embodiment.

With the reactor having the horizontal configuration, the reactor 1β, in which the couple core portion 24 is disposed not only on the outer periphery of the coil 10 but also at both ends of the internal core portion 22, can be easily formed. That is, the reactor 1β including the internal core portion 22 whose entire outer periphery is covered by the couple core portion 24 can be formed. Moreover, the reactor 1β can have a height smaller than that of the third embodiment. Because the cushioning member 70 is disposed on the outer periphery of the internal core portion 22, even when the reactor 1β is subjected to a thermal cycle, a stress due to contraction of the interposed resin portion 31*i* interposed between the coil 10 and the cushioning member 70 is reduced, and therefore cracking of the interposed resin portion 31*i* is prevented.

Fourth Embodiment

Figure 13:
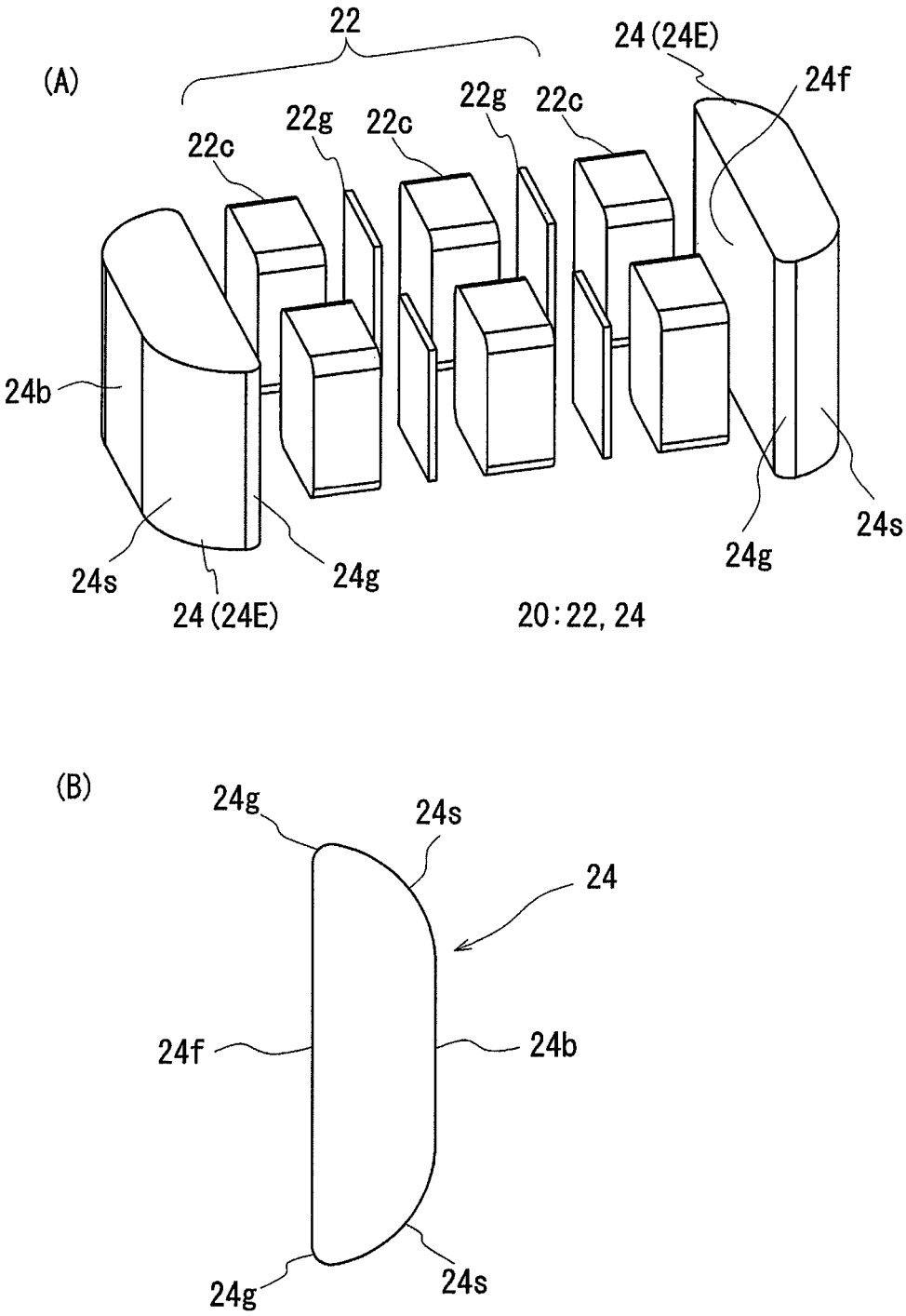
FIG. 13(A) is an exploded perspective view of a core used in a reactor according to a fourth embodiment.
FIG. 13(B) is a plan view of a couple core portion of the core.

Next, referring to FIGS. 13 and 14, a fourth embodiment, which is characterized by the configuration of the couple core portions, will be described. Except for the couple core portions 24 (end core members 24E), other configurations of a reactor according to the present embodiment is the same as that of the first embodiment, including configurations that the cushioning members are disposed outside the internal core portions and that the reactor includes the internal resin portion. Therefore, the difference will be mainly described below, and description of the same configuration will be omitted.

The couple core portion 24 of the reactor according to the present embodiment differs from the couple core portion 24 in first embodiment in that chamfered corner portions 24*g* are formed by chamfering ridges that are formed by an inner end surface 24*f*, which faces the internal core portion 22 and an end surface of the coil, and side surfaces 24*s* that are adjacent to the inner end surface 24*f*. The couple core portion 24 is a block-like member made of a material the same as that of the core pieces 22*c*. Here, the couple core portion 24 is formed of a powder molded product made from soft magnetic powder and has a substantially trapezoidal cross section. The couple core portion 24 includes an inner end surface 24*f* that faces an end surface of the coil molded product 1M, an outer end surface 24*b* that is opposite the inner end surface 24*f* and that is exposed outward from the annular core, and the two side surfaces 24*s* that connect the inner end surface 24*f* and the end surface 24*b* to each other.

Moreover, the chamfered corner portions 24*g* are formed at the ridges formed by the inner end surface 24*f* and the side surfaces 24*s*. In the present embodiment, the chamfered corner portions 24*g*, which have a uniform curvature along the up-down direction of the couple core portion 24, are formed by rounding the ridges. It is preferable that the chamfered corner portions 24*g* be formed at the same time of molding a powder molded product by using a mold corresponding to the rounded ridges. Alternatively, a powder molded product that has unrounded ridges may be formed, and then the ridges may be postprocessed by, for example, cutting, grinding, and polishing to form the chamfered corner portions 24*g*. In the present embodiment, the radius of arc of the chamfered corner portions 24*g* is 3 mm. It is preferable that the radius of arc be in the range of about 1 mm to 10 mm. The cross sectional area of the couple core portion needs to be larger than the cross sectional area of the internal core portion. The cross sectional shape of the chamfered corner portions 24*g* is not limited to an arc shape, and the cross sectional shape may be that of a ridge chamfered with planes.

Figure 14:
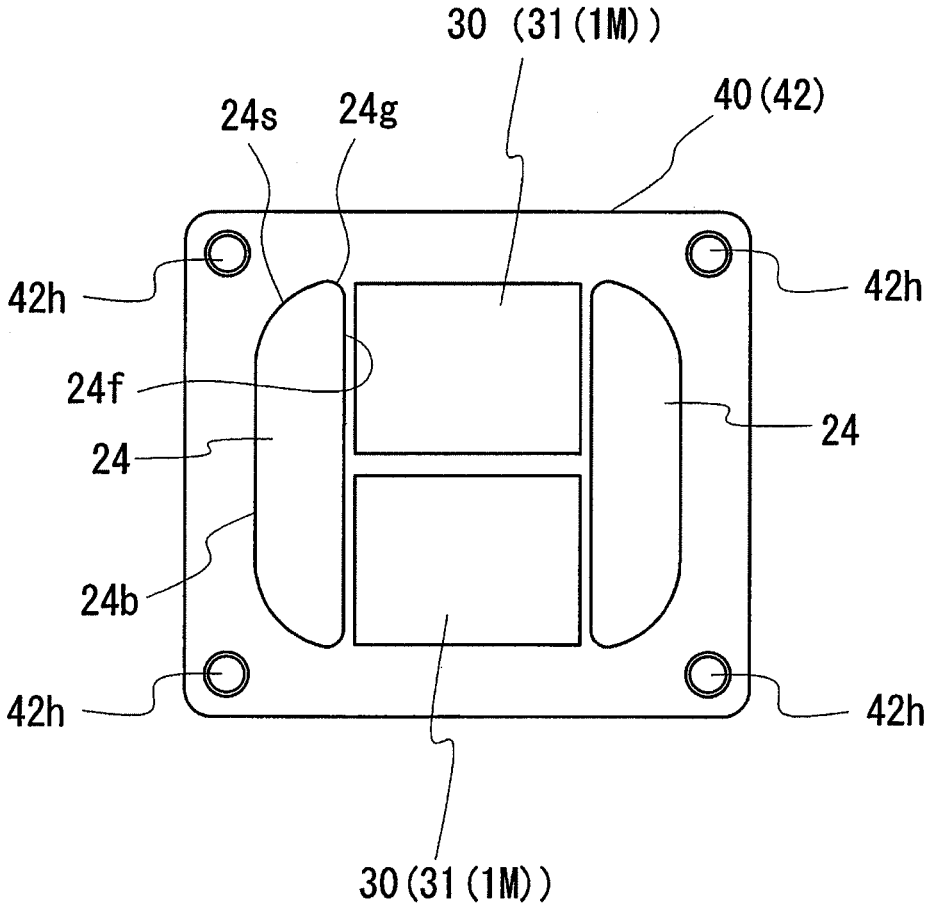
FIG. 14 is a bottom view of the reactor according to the fourth embodiment.

As illustrated in FIG. 14, when an assembly is formed by assembling the coil molded product 1M and the couple core portions 24, the chamfered corner portions 24*g* form grooves between the side surfaces 24*s* of the couple core portion 24 and the side surfaces of the turn covering portion 31 of the coil molded product 1M. When molding the external resin portion 40 (FIG. 14) on the outside of the assembly, the grooves function as guide grooves for introducing the resin material of the external resin portion 40 into spaces between the inner end surfaces 24*f* of the couple core portions 24 and the end surfaces of the coil molded product 1M. The couple core portions 24 are disposed so as to connect the ends of the pair of parallelly disposed internal core portions 22 to each other, and the couple core portions 24 are joined to the internal core portions 22 by using an adhesive. By joining these internal core portions 22 and the couple core portions 24 to each other, the core 20 (FIG. 13(A)) having a closed-loop shape (annular shape) is formed. In a state in which the internal core portion 22 and the couple core portion 24 are joined to each other, the side surfaces of the couple core portion 24 protrude further outward than the outer side surfaces of the internal core portions 22. Therefore, when the coil is disposed on the outer peripheries of the internal core portions 22, almost the entire peripheries of the end surfaces of the coil faces the inner end surfaces 24*f* of the couple core portions.

When molding the external resin portion 40 by using such couple core portions in the same way as illustrated in FIG. 7, grooves have been formed between the chamfered corner portions 24*g* of the couple core portions 24 and the end surfaces of the coil molded product 1M. Therefore, an unsaturated polyester to become the external resin portion 40 easily enters spaces between the inner end surface 24*f* of the couple core portion and the end surfaces of the turn covering portion 31 (FIG. 14) through the grooves. As a result, spaces between the coil molded product 1M and the couple core portions 24 are sufficiently filled with the resin material of the external resin portion 40, and holes are not generated in the external resin portion 40.

Because the chamfered corner portions 24*g* are formed, the ridges of the couple core portion 24 are prevented from being chipped when the couple core portion 24 is handled by a manipulator or the like or when the couple core portion 24 contacts other members. Moreover, because the ridges do not have sharp corners, insulation coating of the coil is easily prevented from being damaged even if the couple core portion 24 contacts the coil.

Fifth Embodiment

Figure 15:
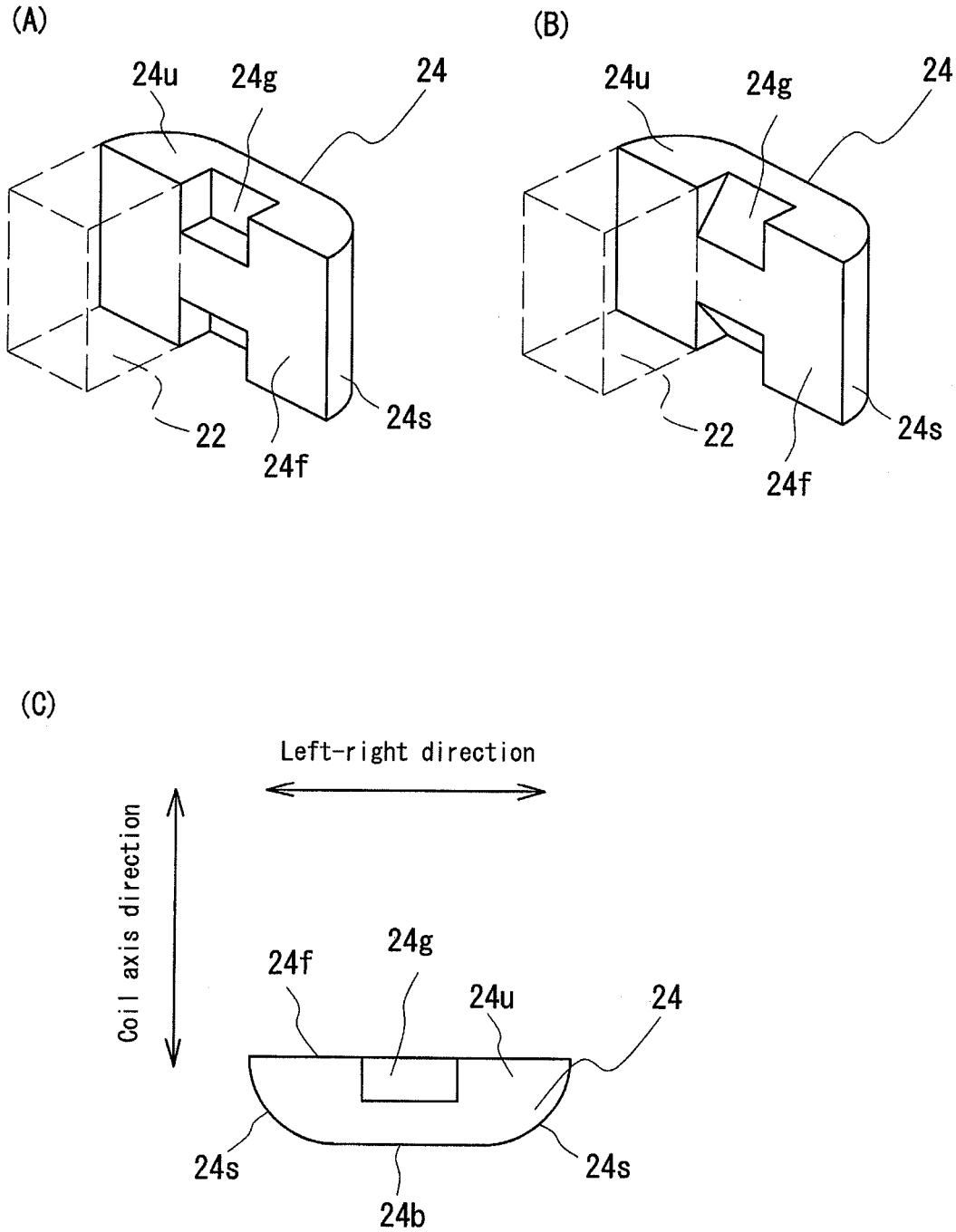
FIG. 15 illustrates a core used in a reactor according to a fifth embodiment, FIG. 15(A) illustrating a partial perspective view of a core including chamfered corner portions having a rectangular shape, FIG. 15(B) illustrating a partial perspective view of a core including chamfered corner portions having a triangular shape, and FIG. 15(*c*) illustrating a plan view of a couple core portion illustrated in FIGS. 15(A) and 15(B).

Next, referring to FIG. 15, a reactor according to the present invention, which has chamfered corner portions different from those of the fourth embodiment will be described. The reactor according to the present embodiment differs from that of the first embodiment in that the couple core portions have different shapes and in that the reactor does not include an internal resin portion. Because the present embodiment is the same as the first embodiment in other respects, mainly the differences will be described below. In FIG. 15, the couple core portion 24 is illustrated by solid lines, and only one of the internal core portions 22 is illustrated by broken lines and the other one is omitted. For convenience of description, the size of the chamfered corner portions 24*g* is exaggerated than the actual size.

In the present embodiment, the cross sectional shape of the couple core portion 24 is substantially trapezoidal as in the fourth embodiment. The couple core portion 24 has a height the same as that of the internal core portion 22, and the upper and lower surfaces (upper surface 24*u*) of the couple core portion 24 are flush with the upper and lower surfaces of the internal core portion 22. When an annular core is formed by assembling the internal core portion 22 and the couple core portion 24, the core becomes a flat core in that the outer peripheral surface of the core is continuous between the internal core portion 22 and the couple core portion 24 and side surfaces of the couple core portion 24 do not protrude further outward than the side surfaces of the internal core portion 22. That is, when the coil elements are disposed outside the internal core portions 22, a portion of the inner end surface 24*f* of the couple core portion 24 that faces an end surface of the coil is a region that faces a portion in which wires of the coil elements are disposed side by side and in parallel with each other.

In the couple core portion 24, chamfered corner portions 24*g* are formed at the ridges that are formed by the inner end surface 24*f* and the upper and lower surfaces (upper surface 24*u*) of the couple core portion. To be specific, as illustrated in FIG. 15(A), the chamfered corner portions 24*g* are formed by forming cut-out portions in the middle in the left-right direction of the couple core portion 24 (a horizontal direction that is perpendicular to the coil axis direction). The chamfered corner portions 24*g* are formed at portions that face an end surface of the coil when the coil is disposed outside the internal core portion 22. Alternatively, as illustrated in FIG. 15(B), another type of chamfered corner portions 24*g* may be formed by forming cut-out portions that have triangular cross sections at the same position on the couple core portion 24.

To form a reactor by using such a core, first, the coil is disposed outside the internal core portion 22. Next, the couple core portions 24 are joined to the end surfaces of the internal core portions 22. Then, the outer periphery of the assembly including the core and the coil is covered by the external resin portion (see FIGS. 1 and 2).

Also in the present embodiment, the resin material of the external resin portion can be guided around the chamfered corner portions to spaces between the coil elements at the end surfaces of the coil. Therefore, as compared with the case where the chamfered corner portions are not present, a space between the coil and the core can be more reliably filled with the external resin portion.

The embodiments described are not limited to the configurations described above, and can be appropriately modified within the scope of the present invention.

[Additional Remarks]

On the basis of the description above, the following inventions can be included in the scope of the present invention.

(A) A reactor including a coil and a core, the coil being formed by helically winding a wire, the core including an internal core portion and a couple core portion, the internal core portion being disposed inside the coil and forming a part of a closed magnetic path, the couple core portion being joined to the internal core portion and forming a remaining part of the closed magnetic path, the reactor being characterized by comprising:

an external resin portion that covers at least a part of an assembly including the coil and the core, wherein the couple core portion includes a chamfered corner portion at a ridge formed by an inner end surface and an adjacent surface that is connected to the inner end surface, the inner end surface facing an end surface of the coil.

(B) The reactor according to additional remark (A), wherein the chamfered corner portion is formed by rounding the ridge.

(C) The reactor according to additional remark (A) or (B), wherein at least one of surfaces of the couple core portion, the surfaces being opposite to each other in a direction in which the reactor is mounted, protrudes further than at least one of surfaces of the internal core portion, the surfaces being opposite to each other in the direction in which the reactor is mounted.

(D) The reactor according to any one of additional remarks (A) to (C), wherein the adjacent surface of the couple core portion is a side surface that is adjacent to the inner end surface.

(E) The reactor according to any one of additional remarks (A) to (C), wherein the adjacent surface of the couple core portion is an upper surface that is adjacent to the inner end surface, and wherein the chamfered corner portion is formed so as to face a portion of the end surface of the coil at which wires of the coil elements are disposed side by side and in parallel with each other.

(F) The reactor according to any one of additional remarks (A) to (E), wherein the core is a powder molded product.

(G) The reactor according to any one of additional remarks (A) to (F), further comprising an internal resin portion that retains the shape of the coil, wherein the external resin portion covers at least a part of an assembly including the core and the coil provided with the internal resin portion.

(H) A reactor including a coil and a core on which the coil is disposed, the reactor being characterized by comprising:

an internal resin portion that covers an outer periphery of the coil and retains a shape of the coil;

an external resin portion that covers at least a part of an outer periphery of an assembly including the core and the coil provided with the internal resin portion; and a positioning portion that is integrally formed with the internal resin portion, that is used to position the assembly with respect to a mold when forming the external resin portion by using the mold, and that is not covered by the external resin portion.

(I) The reactor according to additional remark (H), wherein the coil includes a pair of coil elements and a couple portion that couples the pair of coil elements to each other, wherein the couple portion protrudes further than turn-formed faces of the pair of coil elements, and wherein the positioning portion is formed in the internal resin portion at a position at which the internal resin portion covers the couple portion.

(J) A coil molded product used for a reactor including an assembly including a coil and a core on which the coil is disposed, at least a part of an outer periphery of the assembly being covered by an external resin portion, the coil molded product comprising:

an internal resin portion that covers an outer periphery of the coil and retains a shape of the coil; and a positioning portion that is integrally formed with the internal resin portion, that is used to position the assembly with respect to a mold when forming the external resin portion by using the mold, and that is not covered by the external resin portion.

(K) A method of manufacturing a reactor by forming an assembly including a coil and a core and by covering at least a part of an outer periphery of the assembly by an external resin portion, the method comprising:

a step of forming a coil molded product including the coil and an internal resin portion that covers an outer periphery of the coil and that retains a shape of the coil; and a step of forming the external resin portion by placing the assembly including the coil molded product and the core in a mold, filling the mold with resin, and hardening the resin, the external resin portion covering at least a part of the outer periphery of the assembly, wherein a positioning portion is integrally formed with the internal resin portion, and positioning of the assembly with respect to the mold is performed by fitting the positioning portion into the mold when placing the assembly in the mold.

INDUSTRIAL APPLICABILITY

A reactor and a reactor component according to the present invention can be used as a component of a converter or the like. In particular, the reactor and the reactor component can be preferably used as a reactor for a vehicle such as a hybrid vehicle or an electric vehicle.

REFERENCE SIGNS LIST

1, 1α, 1β reactor
1M coil molded product
1A assembly
10 coil
10A, 10B coil element
10*w* wire
10*t* turn portion
10*f* turn-formed face
10*r* couple portion
10*e* end (end of wire)
20 core
22 internal core portion
22*c* core piece
22*g* gap member
24 couple core portion
24*b* outer end surface
24*f* inner end surface
24*s* side surface
24*u* upper surface
24*g* chamfered corner portion
24E end core member
30 internal resin portion
31 turn covering portion
31*i* interposed resin portion
31*h* sensor-use hole
31*o* hollow bore
33 couple portion covering portion
40 external resin portion
40*i* interposed resin portion
41*h* sensor-use hole
42 flange portion
42*h* through hole
42*c* metal collar
43 nut accommodating hole
50 metal terminal
52 connection face
52*h* insertion hole
54 weld face
60 nut
70 cushioning member
80 pre-molded product
82 nut accommodating hole
90 bobbin
92 frame-like bobbin
100 mold
100*b* base portion
100*c* lid portion
101 cavity
110 fitting groove
111, 112, 113 recess
120 case
120*h* bolt hole
121 guide protrusion
122 bottom surface
123 positioning portion
124 sidewall
126 attachment portion
210 terminal
220 bolt

The invention claimed is:

1. A reactor including a coil and a core, the coil being formed by helically winding a wire, the core including an internal core portion and a couple core portion, the internal core portion being disposed inside the coil and forming a part of a closed magnetic path, the couple core portion being joined to the internal core portion and forming a remaining part of the closed magnetic path, the reactor being characterized by comprising:

a resin portion including an internal resin portion, the internal resin portion including a region that is interposed between the coil and the internal core portion; and a cushioning member that is interposed between the resin portion in the region and the internal core portion and that reduces a stress that acts on the resin portion in the region, wherein a material of the cushioning member has a Young's modulus that is smaller than that of a resin material of the resin portion, wherein the internal resin portion covers at least a part of the coil and retains a shape of the coil, wherein the coil is covered by the internal resin portion and the internal resin portion retains the coil in a compressed state, wherein the resin portion further includes an external resin portion that covers at least a part of an outer periphery of an assembly including the core and the coil provided with the internal resin portion;

a positioning portion that is integrally formed with the internal resin portion, that is used to position the assembly with respect to a mold when forming the external resin portion by using the mold, and that is not covered by the external resin portion, wherein the coil includes a couple portion that couples a pair of coil elements to each other, wherein the couple portion protrudes further than turn-formed faces of the pair of coil elements, and wherein the positioning portion is formed in the internal resin portion at a position at which the internal resin portion covers the couple portion.

2. The reactor according to claim 1, wherein a resin material of the resin portion is an epoxy resin.

3. The reactor according to claim 1, wherein the cushioning member is at least one of a heat shrinkable tube, a cold shrinkable tube, a mold layer, a coating layer, and a tape-wound layer.

4. The reactor according to claim 1, wherein the coil includes a single coil element, wherein the internal core portion is a rod-like core member that is inserted into the coil element, and wherein the couple core portion is an external core member that is coupled to an end of the internal core portion and that is disposed outside the coil element.

5. The reactor according to claim 1, wherein the coil includes the pair of coil elements that are coupled in parallel with each other, wherein the internal core portion is a pair of middle core members each of which is inserted into a corresponding one of the coil elements, and wherein the couple core portion is a pair of end core members that are disposed at ends of the middle core members so as to form an annular core by connecting the pair of middle core members to each other.

6. The reactor according to claim 5, wherein each end core member includes a chamfered corner portion at a ridge formed by an inner end surface and an adjacent surface that is connected to the inner end surface, the inner end surface facing an end surface of the coil.

7. The reactor according to claim 6, wherein the chamfered corner portion is formed by rounding the ridge.

8. The reactor according to claim 6, wherein at least one of surfaces of each end core member, the surfaces being opposite to each other in a direction in which the reactor is mounted, protrudes further than at least one of surfaces of the internal core portion, the surfaces being opposite to each other in the direction in which the reactor is mounted.

9. The reactor according to claim 6, wherein the adjacent surface of the end core member is a side surface that is adjacent to the inner end surface.

10. The reactor according to claim 6, wherein the adjacent surface of the end core member is an upper surface that is adjacent to the inner end surface, and wherein the chamfered corner portion is formed so as to face a portion of the end surface of the coil at which wires of the coil elements are disposed side by side and in parallel with each other.

11. The reactor according to claim 1, wherein the core has one of the following compositions (1) to (2):

(1) both of the internal core portion and the couple core portion are molded products of magnetic powder; and (2) the internal core portion is a molded product of magnetic powder and the couple core portion is a molded product of a mixture of magnetic powder and a resin.

* * * * *